US008701858B2

(12) United States Patent
Iwamura et al.

(10) Patent No.: US 8,701,858 B2
(45) Date of Patent: Apr. 22, 2014

(54) BANKNOTE HANDLING APPARATUS

(75) Inventors: Michiharu Iwamura, Hyogo (JP); Yoshikatsu Mizushima, Hyogo (JP); Shusuke Hashimoto, Hyogo (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/532,294

(22) Filed: Jun. 25, 2012

(65) Prior Publication Data

US 2013/0001040 A1 Jan. 3, 2013

(30) Foreign Application Priority Data

Jun. 30, 2011 (JP) ..... 2011-145580

(51) Int. Cl.
*G07F 7/04* (2006.01)

(52) U.S. Cl.
USPC ..... 194/206

(58) Field of Classification Search
USPC ..... 194/200, 206, 207, 215, 216, 217; 235/379; 209/534; 902/25, 26; 700/215, 225, 226
See application file for complete search history.

(56) References Cited

U.S. PATENT DOCUMENTS

| | | | | |
|---|---|---|---|---|
| 2002/0008138 | A1 | 1/2002 | Yamauchi et al. | |
| 2009/0229947 | A1 * | 9/2009 | Takai et al. | 194/206 |
| 2009/0229950 | A1 | 9/2009 | Nakamoto | |
| 2012/0173013 | A1 | 7/2012 | Nakamoto et al. | |

FOREIGN PATENT DOCUMENTS

| | | |
|---|---|---|
| CN | 101908242 A | 12/2010 |
| JP | 4-37983 | 2/1992 |

* cited by examiner

*Primary Examiner* — Mark Beauchaine
(74) *Attorney, Agent, or Firm* — Renner, Kenner, Greive, Bobak, Taylor & Weber

(57) ABSTRACT

A banknote handling apparatus is operable in a code management mode in which banknotes stored in a storage unit are managed based on codes of the banknotes read by a recognition unit, and in a count management mode in which the banknotes stored in the storage unit are managed by counting the number of the banknotes to be stored in the storage unit. The banknote handling apparatus is switchable between the code management mode and the count management mode.

7 Claims, 16 Drawing Sheets

FIG.11A

FIG.4A

| TYPE OF COUNTER | | DENOMINATION | SIZE/ DENOMINATION |
|---|---|---|---|
| ACTUAL INVENTORY AMOUNT | FIRST STORAGE CASSETTE | 128 DENOMINATIONS | 2 BYTES/ DENOMINATION |
| | SECOND STORAGE CASSETTE | 128 DENOMINATIONS | 2 BYTES/ DENOMINATION |
| | THIRD STORAGE CASSETTE | 128 DENOMINATIONS | 2 BYTES/ DENOMINATION |
| | UPPER FOURTH STORAGE CASSETTE | 128 DENOMINATIONS | 2 BYTES/ DENOMINATION |
| | LOWER FOURTH STORAGE CASSETTE | 128 DENOMINATIONS | 2 BYTES/ DENOMINATION |
| | RECONCILIATION CASSETTE | 128 DENOMINATIONS | 2 BYTES/ DENOMINATION |
| | COLLECTION CASSETTE | 128 DENOMINATIONS | 2 BYTES/ DENOMINATION |
| IN-STORAGE INVENTORY AMOUNT | | 128 DENOMINATIONS | 2 BYTES/ DENOMINATION |

FIG.4B

| TYPE OF SERIAL NUMBER LIST | NUMBER OF BANKNOTES | SIZE/ BANKNOTE |
|---|---|---|
| FIRST STORAGE CASSETTE | 3000 | 16 BYTES/ BANKNOTE |
| SECOND STORAGE CASSETTE | 3000 | 16 BYTES/ BANKNOTE |
| THIRD STORAGE CASSETTE | 3000 | 16 BYTES/ BANKNOTE |
| UPPER FOURTH STORAGE CASSETTE | 3000 | 16 BYTES/ BANKNOTE |
| LOWER FOURTH STORAGE CASSETTE | 3000 | 16 BYTES/ BANKNOTE |
| RECONCILIATION CASSETTE | 3000 | 16 BYTES/ BANKNOTE |
| COLLECTION CASSETTE | 5000 | 16 BYTES/ BANKNOTE |
| DISPENSING UNIT | 220 | 16 BYTES/ BANKNOTE |
| REJECTED BANKNOTE ESCROW UNIT | 520 | 16 BYTES/ BANKNOTE |

1
23
231
232
211(21)
51
33
25
41
411
$31_{-1}$
$31_{-2}$
$31_{-3}$
$31_{-4U}$
$31_{-4L}$
3
53

(BANKNOTES TO BE DISPENSED HAVE BEEN FED)
TARGET GROUP
COUNTER

+1(1)
+1(2)
+1(3)
+1(4)
+1(5)
READ
BN
LBN
COUNTER (2)
NOT READ
COUNTER (3)
ADDITIONALLY FED WHEN READING FAILED
COUNTER

PARTIALLY READ
COUNTER (0)
REJECTED

BANKNOTE HANDLING APPARATUS

CROSS-REFERENCE TO RELATED APPLICATION

This application claims priority to Japanese Patent Application No. 2011-145580 filed on Jun. 30, 2011, the disclosure of which including the specification, the drawings, and the claims is hereby incorporated by reference in its entirety.

BACKGROUND

The present disclosure relates to a banknote handling apparatus for handling banknotes each having a unique code.

Japanese Patent Publication No. H04-37983 discloses a banknote depositing machine used in financial institutions. In a depositing transaction, the banknote depositing machine sequentially reads and records serial numbers of deposited banknotes, and stores the banknotes in different storage units according to their denominations. Thus, the banknotes are managed based on the serial numbers. For example, when the depositing transaction is canceled, and the deposited banknotes are returned (hereinafter this process may be referred to as a returning process), the serial numbers of the banknotes fed from the storage units are read and checked against the serial numbers stored during the depositing transaction. Thus, only the banknotes deposited in the depositing transaction can be returned.

In storing the banknotes in the stacking storage unit, the order of the stored banknotes may change. For example, a banknote depositing/dispensing machine disclosed by US 2009/0229947 is configured in view of the possible change of the order of the banknotes. The banknote depositing machine includes a stacking escrow unit, and a plurality of storage units for storing the banknotes according to their denominations. In a depositing transaction, the serial numbers of the banknotes are sequentially read and stored in association with denomination etc., and the banknotes are temporarily stored in the stacking escrow unit. Then, the serial numbers of the banknotes fed from the escrow unit are read again, and checked against the stored serial numbers. Thus, even when the order of the banknotes has changed in storing the banknotes in the stacking escrow unit, the banknotes fed from the escrow unit can be stored in the correct storage units corresponding to their denominations.

SUMMARY

According to a code management technology of managing the banknotes stored in the storage unit by storing codes unique to the banknotes, such as serial numbers, the management using the codes cannot be performed continuously when the stored code and the code of the banknote stored in the storage unit do not match. Such a mismatch may occur, for example, when it is detected that two or more banknotes are overlapped when they are fed in the dispensing process, or when the banknote transported in the depositing process is jammed. When there is a possibility that the stored code and the code of the banknote stored in the storage unit do not match, a reconciliation process needs to be performed by feeding all the banknotes stored in the storage unit, reading their codes, and then storing the fed banknotes in the storage unit again. However, the reconciliation process takes long time because the serial numbers of all the banknotes stored in the storage unit need to be read, and then the banknotes are returned to the storage unit. The apparatus cannot be used during the reconciliation process. Thus, when the apparatus is used in the teller counter, for example, the teller's business may be disturbed.

Whether the codes, particularly the serial numbers printed on the banknotes, are precisely read or not depends on the condition of the banknotes. Thus, the codes cannot be read depending on use conditions of the apparatus, e.g., when many banknotes whose codes are not easy to read are distributed in the apparatus. This makes the management using the codes difficult.

The code management technology can be applied to various processes as described in the above-mentioned patent document, and is advantageous in improving the function of the apparatus. However, the management using the codes may not be performed continuously in some cases, thereby reducing convenience to users.

In view of the foregoing, the disclosed technology has been achieved. The disclosed technology is concerned with avoiding the reduction in convenience of a banknote handling apparatus in which the banknotes are managed using the codes.

The disclosed technology relates to a banknote handling apparatus for handling banknotes each having a unique code. The banknote handling apparatus includes: a storage unit configured to store the banknotes, and feed stored banknotes; a recognition unit configured to read the codes of the banknotes to be stored in the storage unit; and a control unit, wherein the control unit has a code management mode in which the banknotes stored in the storage unit are managed based on the codes read by the recognition unit, and a count management mode in which the banknotes stored in the storage unit are managed by counting the banknotes to be stored in the storage unit, and the banknote handling apparatus is switchable between the code management mode and the count management mode.

The "code" includes the number, character, symbol, and those similar to them provided on the banknote to identify the banknote, and is not limited to a particular one. For example, the code may be a string of numbers or letters, or may be a bar code, a two-dimensional code, etc. The code may be an RFID of an RF tag embedded in each banknote. An example of the code is a serial number of the banknotes, which is a consecutive number given to each of the banknotes. The code may be read optically, electrically, or magnetically, depending on the type of the code. For example, the serial number printed on the banknote can optically be read, and the RFID can electrically be read.

In this configuration, the banknotes stored in the storage unit are managed based on the codes read by the recognition unit in the code management mode. For example, the codes may be stored in order in which the banknotes are stored in the storage unit. In this way, in the code management mode, the number of the banknotes stored in the storage unit can be identified, and each banknote in the storage unit can be identified.

In the count management mode, the number of the banknotes stored in the storage unit is counted, and the banknotes are managed based on the counted number. In the count management mode, each banknote in the storage unit cannot be identified because the codes are not used. However, there is no need to read and store the codes. Thus, for example, even when the apparatus cannot be operated continuously in the code management mode because the accuracy of the reading of the codes is not high, or the stored code information is less reliable, the apparatus can be operated in the count management mode.

Thus, when the apparatus is configured to be switchable between the code management mode and the count management mode, various processes can be performed based on the identification of each banknote stored in the storage unit by selecting the code management mode, thereby advantageously improving the function of the banknote handling apparatus. In addition, when the apparatus cannot be operated in the code management mode, the count management mode is selected so that the banknote handling apparatus can continuously be operated, thereby improving convenience of the banknote handling apparatus.

A switching condition for switching the banknote handling apparatus between the code management mode and the count management mode may previously be determined, and the switching between the code management mode and the count management mode may be performed based on the switching condition.

For example, when the code management mode is selected to improve the function of the banknote handling apparatus, and the code management mode cannot be continued, the mode is manually or automatically switched to the count management mode. This allows continuous operation of the banknote handling apparatus, thereby improving the convenience.

The switching condition may include a condition that a reconciliation process for identifying the banknotes stored in the storage unit is required in the code management mode, and the required reconciliation process is not performed yet.

When the reconciliation process is required in the code management mode, the apparatus cannot be operated continuously in the code management mode unless the reconciliation process is performed. If the banknote handling apparatus is operable only in the code management mode, the apparatus cannot substantially be used until the reconciliation process is finished. However, according to the above-described configuration, when the reconciliation process is required in the code management mode, the mode is switched to the count management mode instead of performing the reconciliation process. Thus, the banknote handling apparatus can be operated continuously.

The banknote handling apparatus further includes a memory unit configured to store the codes of the banknotes stored in the storage unit, and the switching condition may include a condition that a possibility that one of the codes of the banknotes stored in the storage unit does not match one of the codes of the banknotes stored in the memory unit is detected in the code management mode.

Examples of the possibility that the code of the banknote stored in the storage unit does not match the code stored in the memory unit in the code management mode include the case where the number of the banknotes fed from the storage unit may be uncertain due to irregularity which occurred during the transport of the banknotes fed from the storage unit, and the case where the number of the banknotes stored in the storage unit may be uncertain when the banknote is jammed in storing the banknote in the storage unit.

In such cases, the apparatus cannot be operated continuously in the code management mode unless the reconciliation process is performed. However, the banknote handling apparatus can be operated continuously by switching the code management mode to the count management mode.

The switching condition may include a condition that a success rate of the reading of the codes by the recognition unit is not higher than a predetermined value in the code management mode.

When the success rate of the reading of the codes by the recognition unit is not higher than the predetermined value, i.e., when the success rate is relatively low, the apparatus cannot be operated substantially in the code management mode. Thus, when the mode is switched to the count management mode, the banknote handling apparatus can be operated without disturbance.

The switching condition may include a condition that the codes of the banknotes stored in the storage unit match the codes of the banknotes stored in the memory unit in the count management mode.

Specifically, when the code of the banknote stored in the storage unit has matched the code of the banknote stored in the memory unit, the apparatus can be operated in the code management mode. Thus, the function of the banknote handling apparatus can advantageously be improved by switching the count management mode to the code management mode.

The banknote handling apparatus may be configured to be able to select the code management mode or the count management mode. A user may optionally switch the mode between the code management mode and the count management mode to operate the banknote handling apparatus. This improves the convenience to the user.

BRIEF DESCRIPTION OF THE DRAWINGS

FIG. 4A shows a table of counters of the banknote depositing/dispensing machine, and FIG. 4B shows a table of serial number lists.

DETAILED DESCRIPTION

Figure 1:
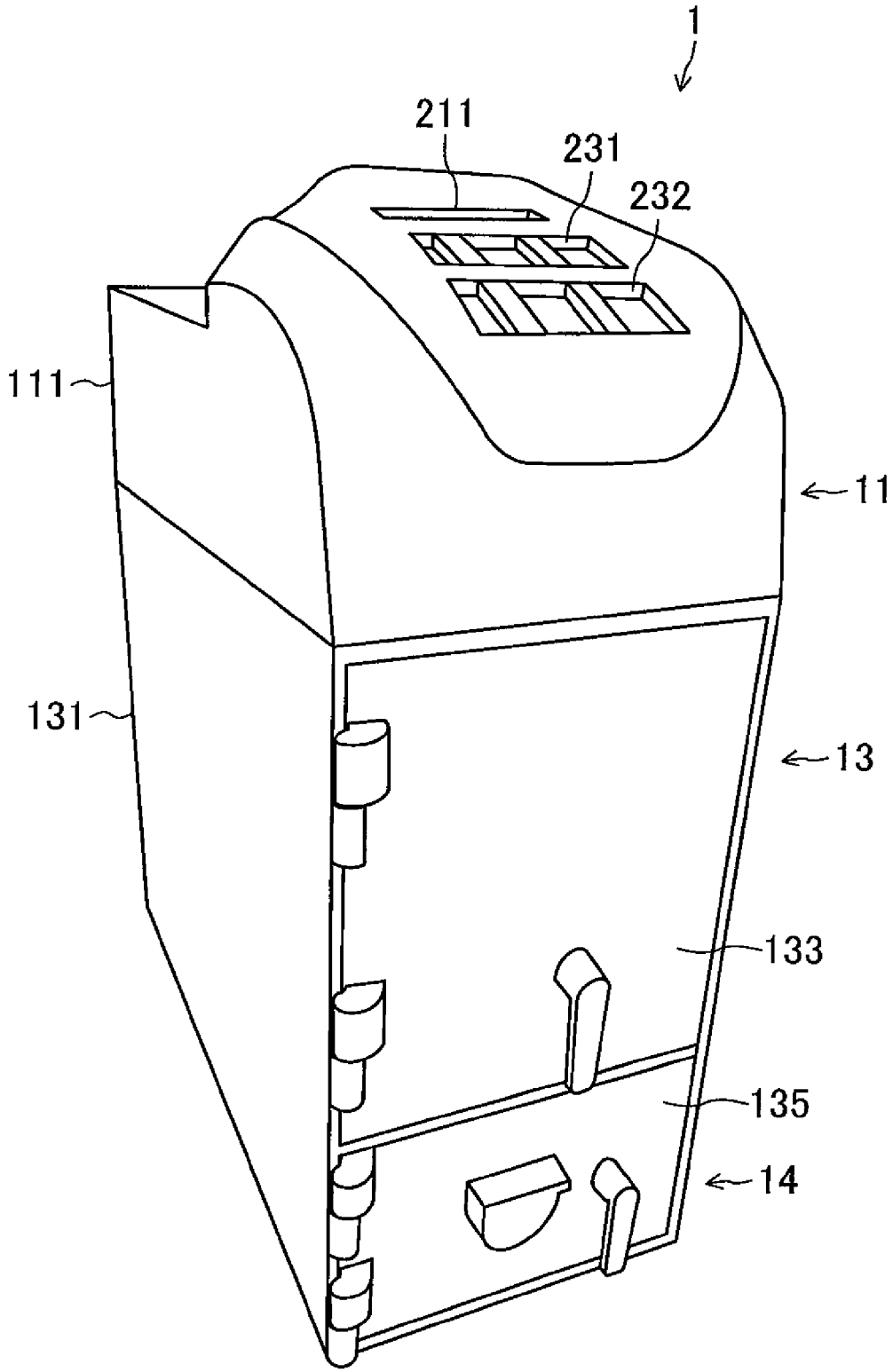
FIG. 1 is a perspective view showing appearance of a banknote depositing/dispensing machine.

An embodiment of a banknote depositing/dispensing machine will be described below with reference to the drawings. The following preferred embodiment will be described merely as an example. FIG. 1 shows appearance of a banknote depositing/dispensing machine (hereinafter merely referred to as a depositing/dispensing machine) 1. The depositing/dispensing machine 1 is placed in a backyard of a shop or a teller counter of a bank.

As described in detail later, the depositing/dispensing machine 1 at least performs a depositing process for storing banknotes placed in an inlet 211 in a storage unit 3, and a dispensing process for dispensing the banknotes stored in the storage unit 3 to a first outlet 231 or a second outlet 232. The depositing/dispensing machine 1 is a so-called circulating depositing/dispensing machine. The banknotes dispensed in the dispensing process include the banknotes stored in the storage unit 3 in the depositing process.

Figure 2:
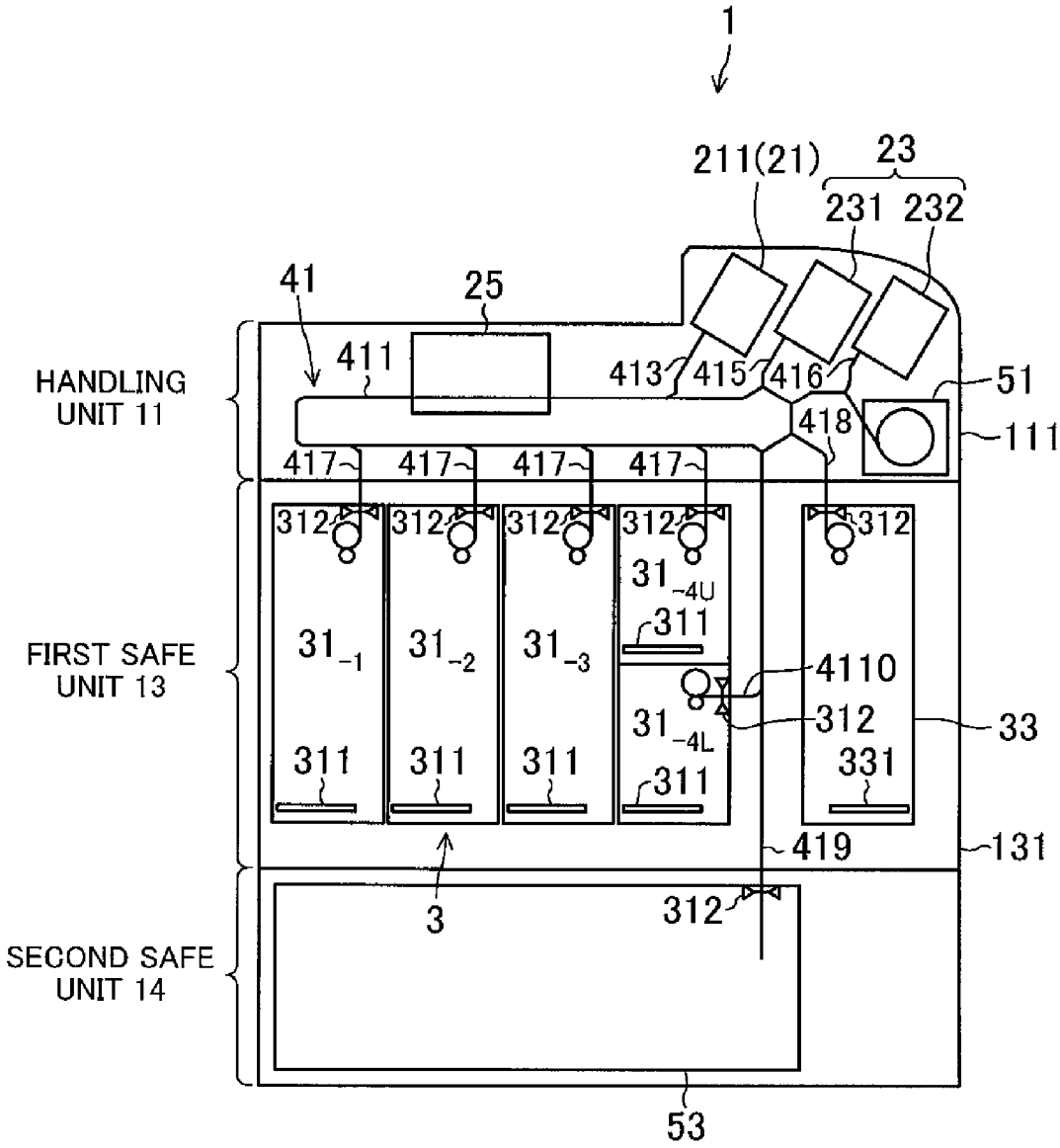
FIG. 2 shows the inside of the banknote depositing/dispensing machine.

As shown in FIGS. 1 and 2, the depositing/dispensing machine 1 is broadly divided into an upper handling unit 11, a first safe unit 13 in the middle, and a lower second safe unit 14. A casing 111 constituting the handling unit 11 contains a depositing unit 21 having the inlet 211, a dispensing unit 23 having the first and second outlets 231 and 232, a recognition unit 25 configured to recognize the banknotes, a rejected banknote escrow unit (hereinafter merely referred to as an escrow unit) 51 for temporarily storing the banknotes, and a transport unit 41 which includes a looped transport path 411 connecting the depositing unit 21, the dispensing unit 23, the recognition unit 25, and the escrow unit 51. A casing 131 arranged below the casing 111 constituting the handling unit 11 constitutes the first and second safe units 13 and 14, and is a protective casing 131 configured to protect the storage unit 3 etc. contained therein at a predetermined security level or higher.

The first safe unit 13 contains the storage unit 3 including a plurality of stacking storage cassettes 31 (4 cassettes in an example shown in the drawings), and a stacking reconciliation cassette 33. The second safe unit 14 contains a collection cassette 53. A first door 133 for opening and closing the first safe unit 13, and a second door 135 for opening and closing the second safe unit 14 are provided in a front surface of the protective casing 131. Access to the first safe unit 13 and access to the second safe unit 14 are authorized to different persons.

As described above, the inlet 211 of the depositing unit 21 is a port in which the banknotes to be deposited are placed in the depositing process. The inlet 211 is opened upward in an upper surface of the casing 111, and can receive a plurality of banknotes at a time. The depositing unit 21 includes a feeding mechanism for feeding the plurality of banknotes placed in the inlet 211 one by one to the looped transport path 411.

As described above, the first and second outlets 231 and 232 of the dispensing unit 23 are ports to which the banknotes are dispensed in the dispensing process, for example. The outlets 231 and 232 are located forward of the inlet 211 (on the right of the inlet in FIG. 2), aligned in a front-back direction, and opened obliquely upward between the upper surface and a front surface of the casing 111. The first and second outlets 231 and 232 can accumulate the transported banknotes, and can hold a plurality of banknotes at a time.

The recognition unit 25 is provided on the looped transport path 411 to recognize authenticity, fitness, and denomination of each of the banknotes transported on the looped transport path 411. Specifically, the recognition unit 25 includes a sensor for detecting the feature of each banknote, such as an image sensor, an infrared sensor, an ultraviolet sensor, or a magnetometric sensor, to determine whether the feature of the transported banknote matches the stored feature of the banknote, thereby recognizing the authenticity, fitness, and denomination of each banknote. The recognition unit 25 can optically read a serial number printed on each of the banknotes. To read the serial number is to obtain an image of the serial number printed on a predetermined position of the banknote, and to recognize letters or numerics of the serial number based on the obtained image. Instead of the recognition unit 25, another reading unit may be provided on the looped transport path 411 to read the serial number. A control unit 513 described later may have functions of the recognition unit 25 except for the sensor.

The transport unit 41 includes the looped transport path 411 endlessly running in the casing 111. The banknotes are transported on the looped transport path 411 clockwise and counterclockwise in FIG. 2. Although not shown, the looped transport path 411 includes a combination of a plurality of rollers, belts, motors for driving them, sensors for detecting the transported banknotes, and guides. The looped transport path 411 allows long edge feed of the banknotes one by one with a predetermined gap kept between the banknotes.

The looped transport path 411 and the inlet 211 are connected through a depositing path 413, and the banknotes placed in the inlet 211 are transported to the looped transport path 411 through the depositing path 413.

To the looped transport path 411, four branch paths 417 connected to the four storage cassettes 31, respectively, are connected through diverters (not shown). Due to operation of the diverters, the banknotes traveling on the looped transport path 411 are selectively transported to any one of the four storage cassettes 31 through the branch path 417, and stored therein, and the banknotes fed from any one of the storage cassettes 31 are transported to the looped transport path 411 through the branch path 417.

To the looped transport path 411, first and second dispensing paths 415 and 416 are connected through diverters (not shown) which change the traveling direction of the banknotes. An end of the first dispensing path 415 is connected to the first outlet 231, and an end of the second dispensing path 416 is connected to the second outlet 232. Each of the diverters is positioned at a junction of three transport paths extending in different directions, and selectively transports the banknotes traveling from one of the transport paths to the other two transport paths. Details of the diverters are described in International Patent Publication WO2009/034758 which is herein incorporated by reference. In this configuration, the banknotes traveling on the looped transport path 411 are selectively transported to the first or second outlet 231 or 232 through the first or second dispensing path 415 or 416 by the operation of the diverter.

To the looped transport path 411, a first connection path 418 connected to the reconciliation cassette 33, and a second connection path 419 connected to the collection cassette 53 are connected through diverters (not shown), respectively. The second connection path 419 vertically penetrates the first safe unit 13, and is provided with a branch path 4110. The branch path 4110 is connected to a lower fourth storage cassette $\mathbf{31}_{-4L}$, described later.

The diverters are positioned at junctions of the first connection path 418 and the second connection path 419, respectively. Each of the diverters is positioned at a junction of three transport paths extending in different directions, and selectively transports the banknotes traveling from one of the transport paths to the other two transport paths. In this configuration, the banknotes traveling on the looped transport path 411 clockwise or counterclockwise are selectively transported to the reconciliation cassette 33 through the first connection path 418, or to the lower fourth storage cassette $\mathbf{31}_{-4L}$ or the collection cassette 53 through the second connection path 419, by the operation of the diverter. The banknotes fed from the reconciliation cassette 33 or the lower fourth storage cassette $\mathbf{31}_{-4L}$, and passed through the first or second connection path 418 or 419 are transported through the looped transport path 411 clockwise or counterclockwise.

As described above, the storage unit 3 includes first to fourth storage cassettes 31 in the example shown in the drawings. In the following description, a set of the four storage cassettes will be indicated by a reference character "31," while the first, second, third, . . . storage cassettes will be indicated by reference characters "$\mathbf{31}_{-1}$, $\mathbf{31}_{-2}$, $\mathbf{31}_{-3}$, . . . " The number of the storage cassettes 31 is not particularly limited as long as more than one storage cassette 31 is provided. In this example, the four storage cassettes 31 are arranged in a depth direction of the apparatus (a right-left direction in FIG. 2). Although not shown in detail in the drawings, the storage unit 3 can be drawn frontward of the apparatus when the door 133 of the first safe unit 13 is open, and each of the storage cassettes 31 are detachable from the apparatus when the storage unit 3 is drawn forward.

The first to third storage cassette $\mathbf{31}_{-1}$, $\mathbf{31}_{-2}$, and $\mathbf{31}_{-3}$ are configured in the same manner, and are narrow in the vertical direction. A port through which the banknotes can pass is formed in an upper surface of each of the storage cassettes 31 to communicate the inside and the outside of the cassette, and the branch path 417 is connected to the port. A table 311 which ascends or descends depending on the amount of the banknotes stacked thereon is provided in each of the storage cassettes 31. Thus, each of the first to third storage cassettes $\mathbf{31}_{-1}$, $\mathbf{31}_{-2}$, and $\mathbf{31}_{-3}$ is configured to stack the banknotes sent to the inside of the cassette from the looped transport path 411 through the port on the table 311 in the order from bottom to top, and to feed the banknotes stacked on the table 311 out of the cassette one by one in the order from top to bottom through the port, i.e., to the looped transport path 411.

The fourth storage cassette $\mathbf{31}_{-4}$ is provided with a divider plate to divide space in the fourth storage cassette $\mathbf{31}_{-4}$ into an upper part (an upper fourth storage cassette $\mathbf{31}_{-4U}$) and a lower part (a lower fourth storage cassette $\mathbf{31}_{-4L}$). A port of the upper fourth storage cassette $\mathbf{31}_{-4U}$ is formed in an upper surface thereof, while a port of the lower fourth storage cassette $\mathbf{31}_{-4L}$ is formed in a side surface thereof. The branch path 417 branched from the looped transport path 411 is connected to the port of the upper fourth storage cassette $\mathbf{31}_{-4U}$, and the branch path 4110 branched from the second connection path 419 is connected to the port of the lower fourth storage cassette $\mathbf{31}_{-4L}$. Thus, the upper fourth storage cassette $\mathbf{31}_{-4U}$ is configured to store the banknotes sent to the inside thereof from the looped transport path 411 through the port by stacking the banknotes on the table 311 in the order from bottom to top, and to feed the banknotes stacked on the table 311 one by one to the looped transport path 411 through the port in the order from top to bottom. The lower fourth storage cassette $\mathbf{31}_{-4L}$ is configured to store the banknotes sent to the inside thereof from the looped transport path 411 through the second connection path 419 and the port by stacking the banknotes on the table 311 in the order from bottom to top, and to feed the banknotes stacked on the table 311 one by one in the order from top to bottom to the second connection path 419 and the looped transport path 411 through the port.

As described in detail later, the reconciliation cassette 33 is used for a reconciliation process performed on each storage cassette 31, and has a volume which is equal to or larger than the storage cassette 31 so that the reconciliation cassette 33 can store all the banknotes stored in each of the storage cassettes 31. The reconciliation cassette 33 is generally empty when the reconciliation process is not performed. In the first safe unit 13, the reconciliation cassette 33 is detachably attached to the casing 131 to be located opposite the fourth storage cassette $\mathbf{31}_{-4}$ relative to the second connection path 419. The reconciliation cassette 33 is a stacking cassette like the storage cassette 31, and is provided with a port formed in an upper surface thereof, and contains a table 331 therein like the storage cassette 31. The port of the reconciliation cassette 33 is connected to the first connection path 418 as described above. The reconciliation cassette 33 is configured to store the banknotes sent from the looped transport path 411 to the inside of the cassette through the port by stacking the banknotes on the table 331 in the order from bottom to top, and to feed the banknotes stacked on the table 331 one by one in the order from top to bottom to the looped transport path 411 through the port. The reconciliation cassette 33 may be used as one of the storage cassettes 31 (a fifth storage cassette) instead of using the reconciliation cassette 33 for the reconciliation process.

The rejected banknote escrow unit 51 is connected to a branch path which is branched from the second dispensing path 416 connected to the second outlet 231. As described in detail later, the escrow unit 51 is a storage unit which temporarily stores the banknotes rejected in the dispensing process, for example. Unlike the stacking storage cassettes 31, the escrow unit 51 is a winding unit. The winding escrow unit includes a tape for guiding the banknotes, a guide, a reel for winding the tape and the banknotes, and a substantially rectangular casing containing the tape, the guide, and the reel as described in Japanese Patent Publication No. 2000-123219. Alternatively, the winding escrow unit 51 includes two tapes for sandwiching the banknotes, a reel for winding the two tapes sandwiching the banknotes, and a casing containing the tapes and the reel as described in International Patent Publication No. WO2011/036782 which is herein incorporated by reference. In either structure, the winding escrow unit winds the banknotes one by one to store them, and feeds the banknotes one by one in a reverse order of the stored order, i.e., the last stored banknote is first fed.

The collection cassette 53 is detachably attached to the second safe unit 14, and is connected to the looped transport path 411 through the second connection path 419 as described above. The collection cassette 53 is a stacking storage unit. However, unlike the storage cassettes 31 and the reconciliation cassette 33 described above, the collection cassette 53 is elongated in the depth direction of the apparatus, and includes a note presser (not shown) which moves in the depth direction. The collection cassette 53 is configured to arrange the banknotes in an upright state in the depth direction, and the note presser moves according to the amount of the banknotes.

Unlike the storage cassettes 31 and the reconciliation cassette 33, the collection cassette 53 cannot feed the banknotes stored therein. The collection cassette 53 stores some of the banknotes placed in the inlet 211 in the depositing process, but not stored in the storage unit 3, i.e., overflowed banknotes. The banknotes which were unrecognizable and rejected in the dispensing process etc. may also be stored in the collection cassette 53.

Figure 3:
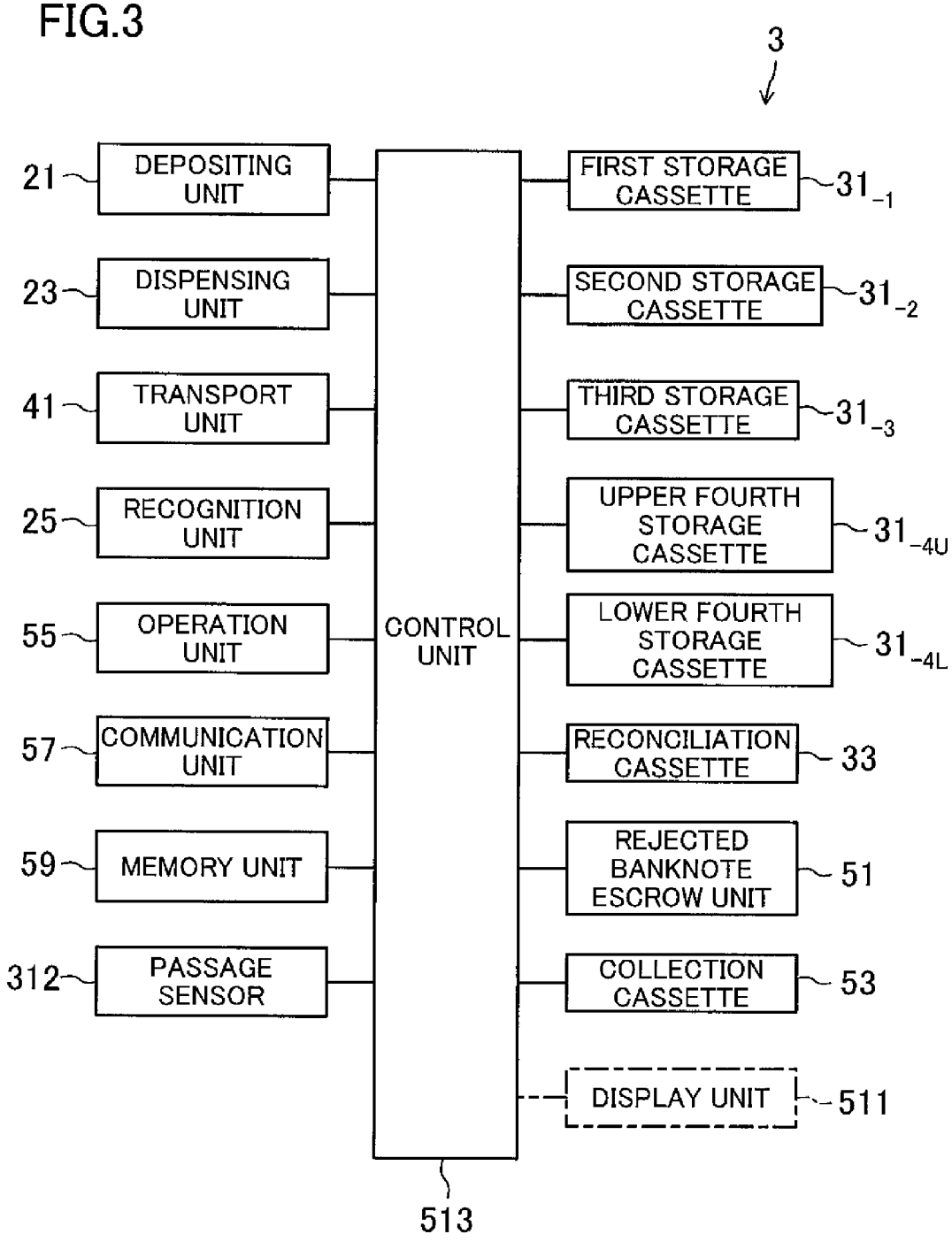
FIG. 3 is a block diagram showing the structure related to control of the banknote depositing/dispensing machine.

FIG. 3 shows a structure associated with control of the depositing/dispensing machine 1. The depositing/dispensing machine 1 includes a control unit 513 which may basically be comprised of a well-known microcomputer. The control unit 513 is connected to the depositing unit 21, the dispensing unit 23, the storage unit 3 including the first to fourth storage cassettes 31, the reconciliation cassette 33, the rejected banknote escrow unit 51, the collection cassette 53, and the transport unit 41 so that signals can be sent and received therebetween. Each of the units 21, 23, 3, 33, 41, 51, and 53 includes a sensor which detects the traveling banknotes, like passage sensors 312 provided at the ports of the storage cassettes 31, the reconciliation cassette 33 and the collection cassette 53, to detect the passage of the banknotes as shown in FIG. 2. Detection signals from the sensors are input to the control unit 513. The control unit 513 outputs control signals based on the input detection signals, and the units 21, 23, 3, 33, 41, 51, and 53 are operated in accordance with the signals.

The control unit 513 is also connected to the recognition unit 25. The recognition unit 25 sends the recognition result and the read serial number to the control unit 513. Although not shown in FIG. 1 etc., the depositing/dispensing machine 1 is also connected to an operation unit 55 as a human interface for an operator of the depositing/dispensing machine 1, such as a teller, a communication unit 57 for sending and receiving signals between the depositing/dispensing machine 1 and a higher-ranking machine and other devices (not shown) through LAN or a serial bus, and a memory unit 59 for storing various types of information, e.g., general-purpose storage devices such as a hard disk drive, a flash memory.

The memory unit 59 stores at least an inventory amount which is the respective numbers of the banknotes of different denominations or the amount of the banknotes stored in the depositing/dispensing machine 1. The memory unit 59 also stores the inventory amount of each storage module 31. FIG. 4A shows a table of counters set in the depositing/dispensing machine 1. An actual inventory amount counter configured to count the banknotes in real-time in storing and feeding the banknotes in and from the cassette is provided in each of the first to fourth storage cassettes 31, the reconciliation cassette 33, and the collection cassette 53. Each of the counters can count the banknotes of 128 denominations, and has a capacity of 2 bytes per denomination. Further, a counter which can count the banknotes of 128 denominations and has a capacity of 2 bytes per denomination is provided as an in-storage inventory amount configured to count the banknotes when the depositing or dispensing process is finished. Counts of these counters increase or decrease based on the detection results of the sensors 312. These counters are used in a serial number management mode and a count management mode described later.

As described in detail later, the depositing/dispensing machine 1 is configured to manage the banknotes using the serial numbers. The memory unit 59 stores a serial number list in which the serial numbers of the banknotes stored in each unit are arranged in the stored order, and each of the serial numbers is associated with a consecutive number corresponding to the number of the stored banknotes. FIG. 4B shows a table of the serial number lists. A capacity of 3000 banknotes, 16 bytes per banknote, is allocated to each of the first to fourth storage cassettes 31 and the reconciliation cassette 33. A capacity of 5000 banknotes, 16 bytes per banknote, is allocated to the collection cassette 53. A capacity of 220 banknotes, 16 bytes per banknote, is allocated to the dispensing unit 23. A capacity of 520 banknotes, 16 bytes per banknote, is allocated to the rejected banknote escrow unit 51.

The depositing/dispensing machine 1 may be provided with an optional display unit 511 made of a flat panel display, for example, for displaying various types of information. The display unit 511 is also connected to the control unit 513. The display unit 511 may be a touch panel display, and the display unit 511 may be integrated with the operation unit 55.

The control unit 513 controls the units 21, 23, 25, 3, 33, 41, 51, 53, 55, 57, 59, and 511 based on a command sent from a higher-ranking terminal through the communication unit 57, and/or various commands received through the operation unit 55. Thus, the depositing/dispensing machine 1 performs various processes including a depositing process, a dispensing process, a collection process, a returning process, and a reconciliation process described below. The processes performed by the depositing/dispensing machine 1 are stored as a log in the memory unit 59.

(Depositing Process)

The depositing process is a process for depositing (storing) the banknotes in the depositing/dispensing machine 1. Each of the banknotes placed in the inlet 211 is stored in any of the storage cassettes 31 based on the results of the recognition by the recognition unit 25, and the predetermined types (denomination, fitness, etc.) of the banknotes allocated to the storage cassette 31. More specifically, the depositing/dispensing machine 1 performs the depositing process in the following manner. When the banknotes are placed in the inlet 211, a command to start the depositing process is input to the depositing/dispensing machine 1 by operating the higher-ranking machine and/or the operation unit 55. As indicated by solid arrows in FIG. 5, the feeding mechanism of the depositing unit 21 feeds the banknotes in the inlet 211 one by one, and the transport unit 41 transports the banknotes to the recognition unit 25. The recognition unit 25 recognizes and counts the banknotes. At this time, the recognition unit 25 reads the serial numbers in real-time.

Figure 5:
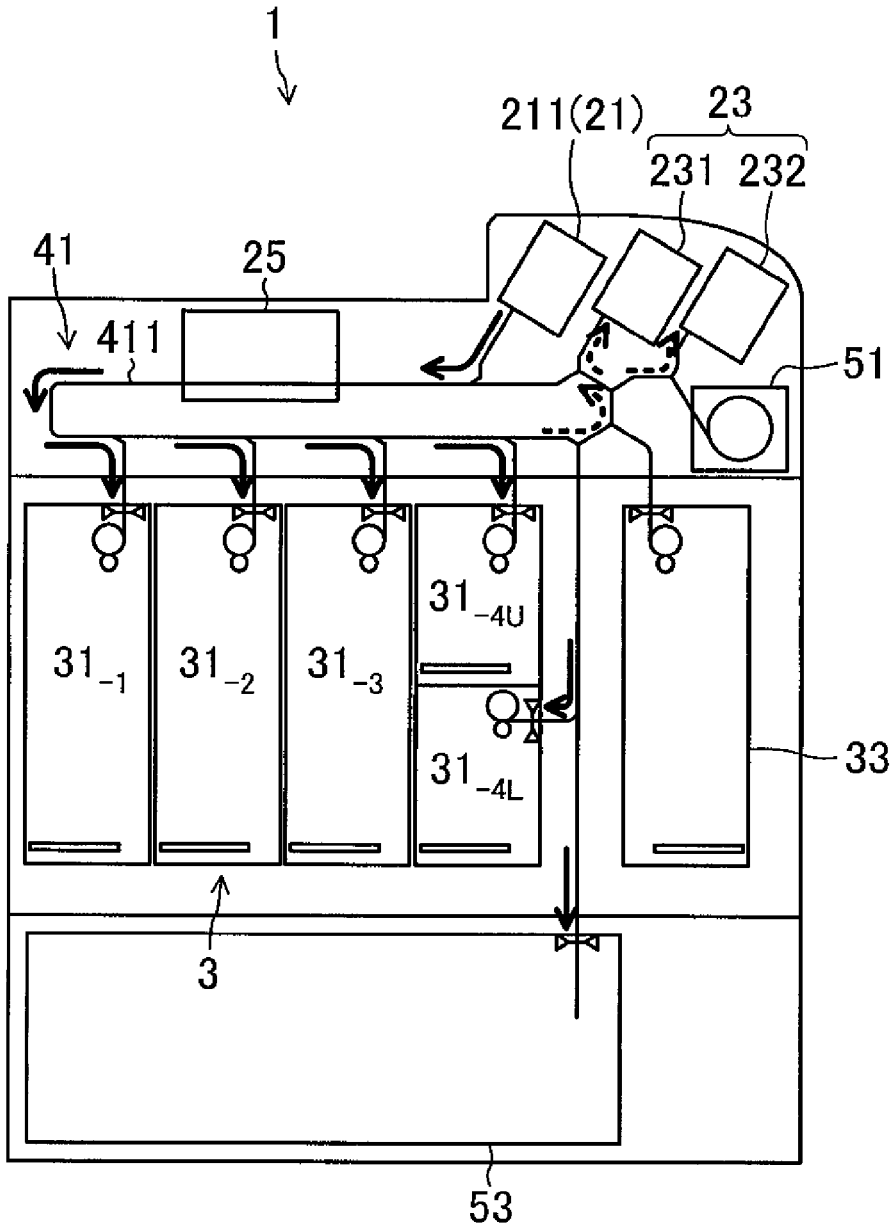
FIG. 5 shows how the banknotes are transported in a depositing process.

The transport unit 41 transports the banknotes which are recognized as acceptable by the recognition unit 25 (the acceptable banknotes will be referred to as normal banknotes in contrast with the rejected banknotes), and all digits of the serial numbers of which are read to the predetermined storage cassette 31 based on the recognition results and the predetermined types of the banknotes allocated to the storage cassette as indicated by solid arrows in FIG. 5. Specifically, each of the banknotes is stored in any one of the first to fourth storage cassettes 31 based on the denomination or fitness. Thus, in the depositing/dispensing machine 1, the banknotes are directly stored in the storage cassette 31 in the depositing process. The banknotes of the denomination which is not allocated to the storage cassette 31 (normal banknotes) and unfit banknotes are stored in the collection cassette 53. When the storage cassette 31 to which the banknotes are allocated is full, the normal banknotes are stored in the collection cassette 53.

The transport unit 41 dispenses the rejected banknotes which cannot be accepted by the depositing/dispensing machine 1, such as the banknotes which cannot be authenticated by the recognition unit 25, to the second outlet 232 as indicated by dashed arrows in FIG. 5. The banknotes rejected in the depositing process are placed again in the inlet 211, and are recognized again by the recognition unit 25.

When the storage cassettes 31 and the collection cassette 53 become full in the depositing process, and the banknotes cannot be stored any more, these banknotes are dispensed to the first outlet 231 as indicated by the dashed arrows in FIG. 5. The rejected banknotes may be dispensed to the first outlet 231, and the banknotes which cannot be stored may be dispensed to the second outlet 232.

The inventory amount stored in the memory unit 59 is updated after the depositing process is finished. Simultaneously, the serial number list in which the serial numbers of the banknotes stored in each of the storage cassettes 31 are arranged in the stored order is updated as the banknotes are stored. The order of the serial numbers in the serial number list is the order in which the banknotes passed the recognition unit 25.

(Dispensing Process)

The dispensing process is a process for dispensing the banknotes stored in the depositing/dispensing machine 1. Specifically, the dispensing process is started by performing predetermined dispensing operation of specifying at least the denomination and the number of the banknotes at the higher-ranking machine and/or the operation unit 55. The storage unit 3 feeds the specified number of the banknotes of the specified denomination from the storage cassette 31 storing the banknotes as indicated by solid arrows in FIG. 6. The transport unit 41 transports the fed banknotes to the recognition unit 25 through the looped transport path 411, and the recognition unit 25 recognizes the banknotes and reads the serial numbers of the banknotes. Then, the normal banknotes are dispensed to the first outlet 231.

Figure 6:
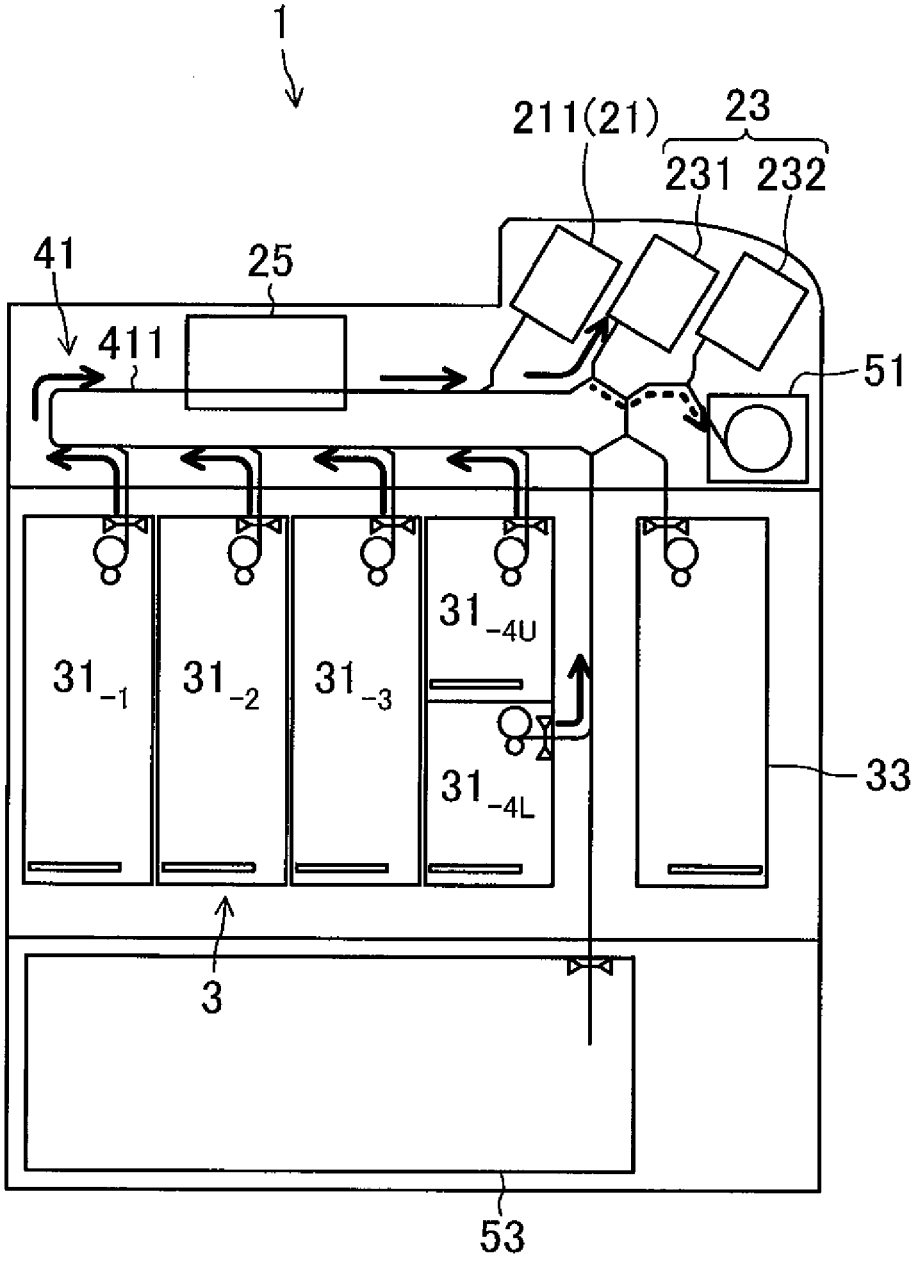
FIG. 6 shows how the banknotes are transported in a dispensing process.

When the banknotes are not recognizable by the recognition unit 25 and are rejected in the dispensing process, the rejected banknotes are transported to the rejected banknote escrow unit 51 as indicated by dashed arrows in FIG. 6, and are stored therein. The banknotes whose serial numbers are not read are also stored in the rejected banknote escrow unit 51. The banknotes stored in the escrow unit 51 are stored in the storage cassette 31 or the collection cassette 53 after the dispensing process is finished, if necessary.

After the dispensing process is finished, the inventory amount stored in the memory unit 59 is updated, and the serial number list corresponding to each of the storage cassettes 31 is also updated as the banknotes are fed.

(Collection Process)

Figure 7:
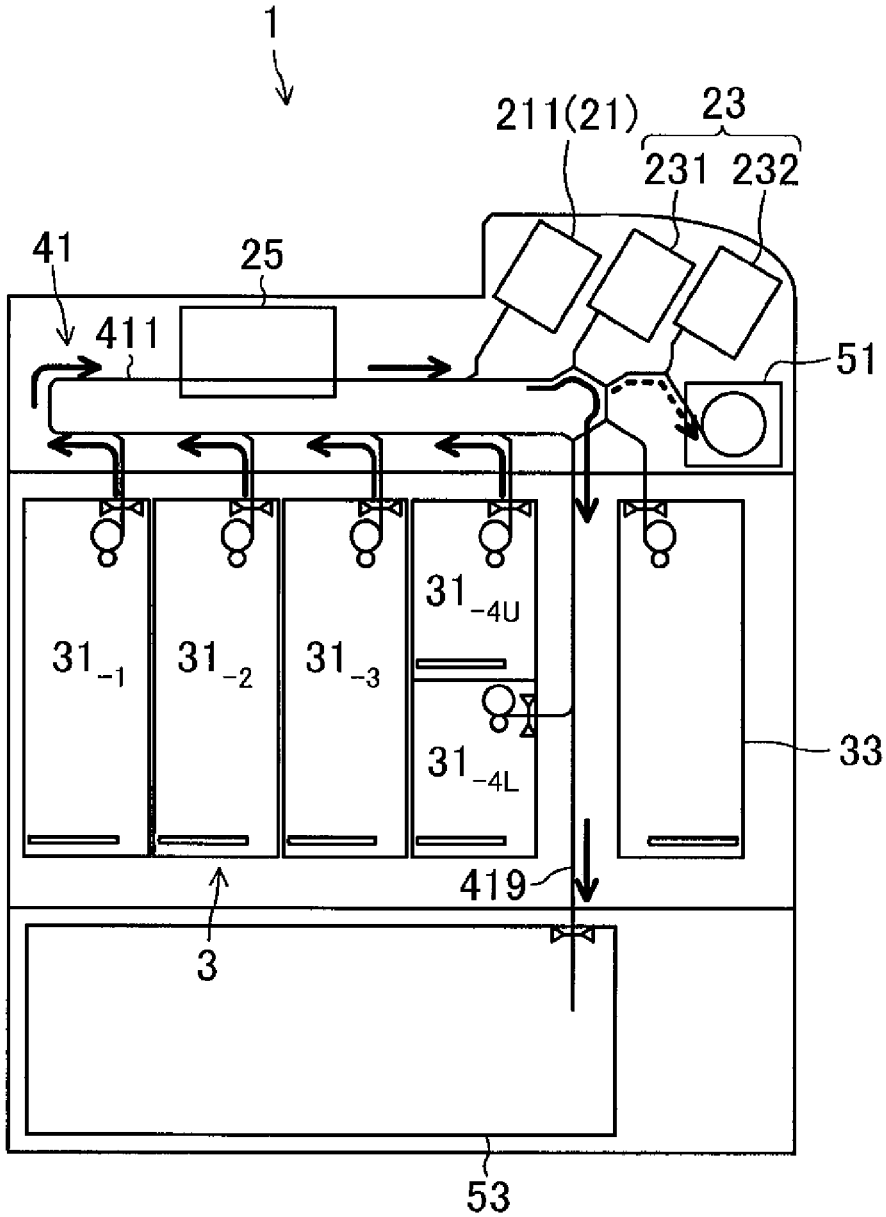
FIG. 7 shows how the banknotes are transported in a returning process.

The collection process is a process for transporting the banknotes stored in the storage cassette 31 to the collection cassette 53. Specifically, the collection process is started by performing predetermined collection operation of specifying at least the denomination at the higher-ranking machine and/or the operation unit 55. When the first to third storage cassettes $\mathbf{31}_{-1}$, $\mathbf{31}_{-2}$, $\mathbf{31}_{-3}$ or the upper fourth storage cassette $\mathbf{31}_{-4U}$ stores the banknotes of the specified denomination, the storage unit 3 sequentially feeds the banknotes of the specified denomination from the storage cassette 31 storing the banknotes as indicated by solid arrows in FIG. 7. The transport unit 41 transports the fed banknotes to the recognition unit 25 through the looped transport path 411, and the recognition unit 25 recognizes the banknotes and reads the serial numbers of the banknotes. Then, the normal banknotes are transported from the looped transport path 411 to the collection cassette 53 through the second connection path 419. Thus, the banknotes are stored in the collection cassette 53. The rejected banknotes are stored in the rejected banknote escrow unit 51 as indicated by dashed arrows in FIG. 7.

Figures 8A, 8B:
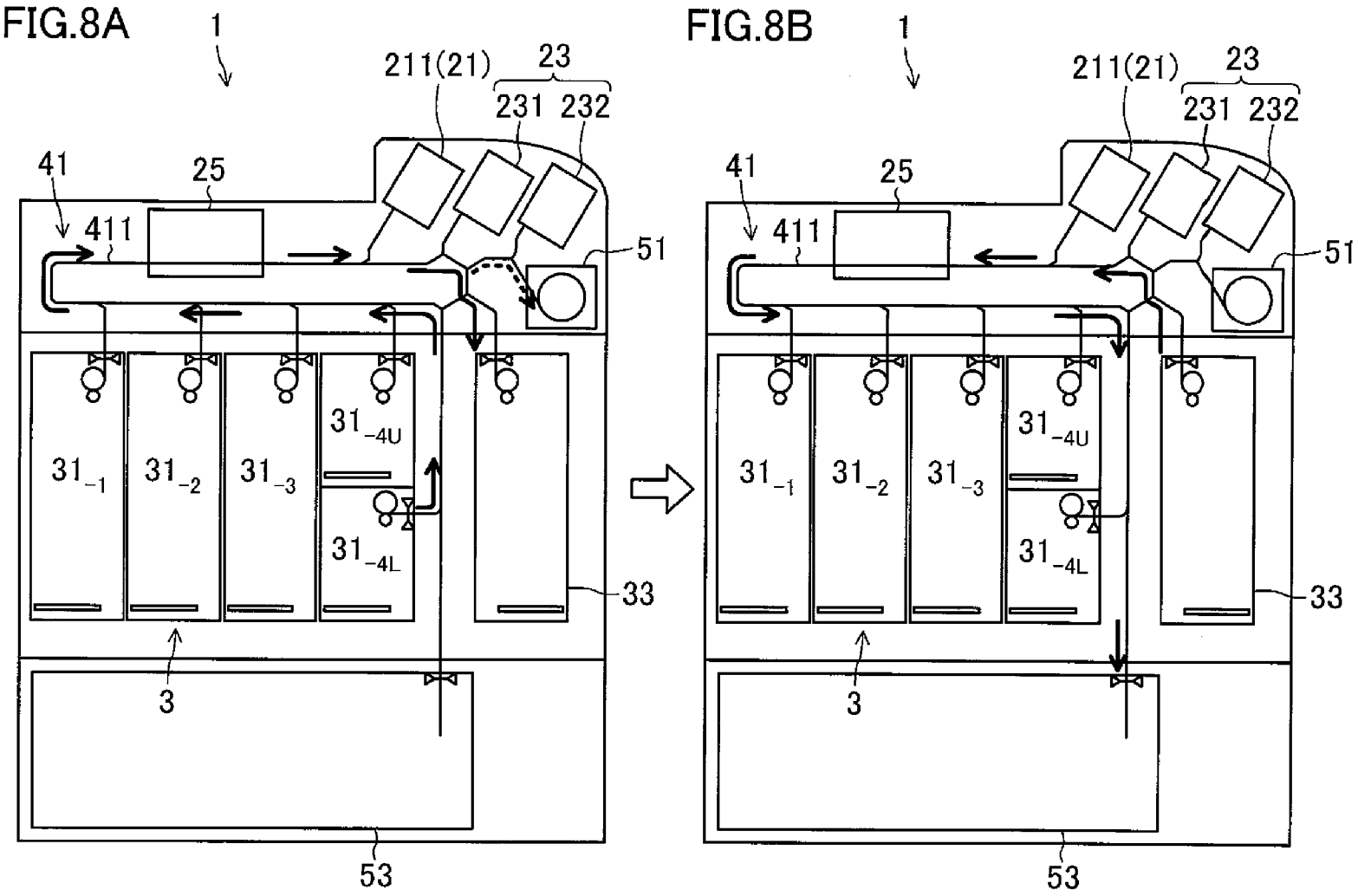
FIGS. 8A and 8B show how the banknotes returned from a lower fourth storage cassette are transported.

When the banknotes of the denomination specified in the collection process are stored in the lower fourth storage cassette $\mathbf{31}_{-4L}$, the transport unit 41 transports the banknotes fed from the lower fourth storage cassette $\mathbf{31}_{-4L}$ to the recognition unit 25 through the second connection path 419 and the looped transport path 411 as shown in FIG. 8A, and the recognition unit 25 recognizes the banknotes and reads the serial numbers of the banknotes. Then, the normal banknotes are transported to the reconciliation cassette 33. The rejected banknotes are stored in the rejected banknote escrow unit 51 as indicated by dashed arrows in FIG. 8A. After all the banknotes fed from the lower fourth storage cassette $\mathbf{31}_{-4L}$ are stored in the reconciliation cassette 33, the reconciliation cassette 33 feeds the banknotes one by one as indicated by solid arrows in FIG. 8B, and the transport unit 41 transports the fed banknotes to the collection cassette 53 through the looped transport path 411 and the second connection path 419. Thus, the banknotes in the lower fourth storage cassette $\mathbf{31}_{-4L}$ are stored in the collection cassette 53.

After the collection process is finished, the inventory amount stored in the memory unit 59 is updated, and the serial number list corresponding to each of the storage cassettes 31 is also updated.

(Reconciliation Process)

The reconciliation process is a process for identifying the banknotes stored in the storage cassette 31. The depositing/dispensing machine 1 can perform a full reconciliation process of feeding all the banknotes stored in the storage cassette 31, and a partial reconciliation process of feeding some of the banknotes stored in the storage cassette 31.

The full reconciliation process is performed when it is detected that the storage cassette 31 is detached from the apparatus, and its door is once opened. When the storage cassette 31 is opened, some of the banknotes stored therein may be removed, or the order of the banknotes may be changed, i.e., the number or the order of the banknotes stored in the opened storage cassette 31 may be uncertain. The full reconciliation process is also performed when the storage cassette 31 is replaced. The full reconciliation process is also performed when the banknotes in the storage cassette 31 have been identified, and the higher-ranking terminal commands the execution of the full reconciliation process to count the banknotes and read the serial numbers of the banknotes to identify the banknotes again. The full reconciliation process may be performed on a single storage cassette 31, or may sequentially be performed on all the storage cassettes 31.

Figure 9B:
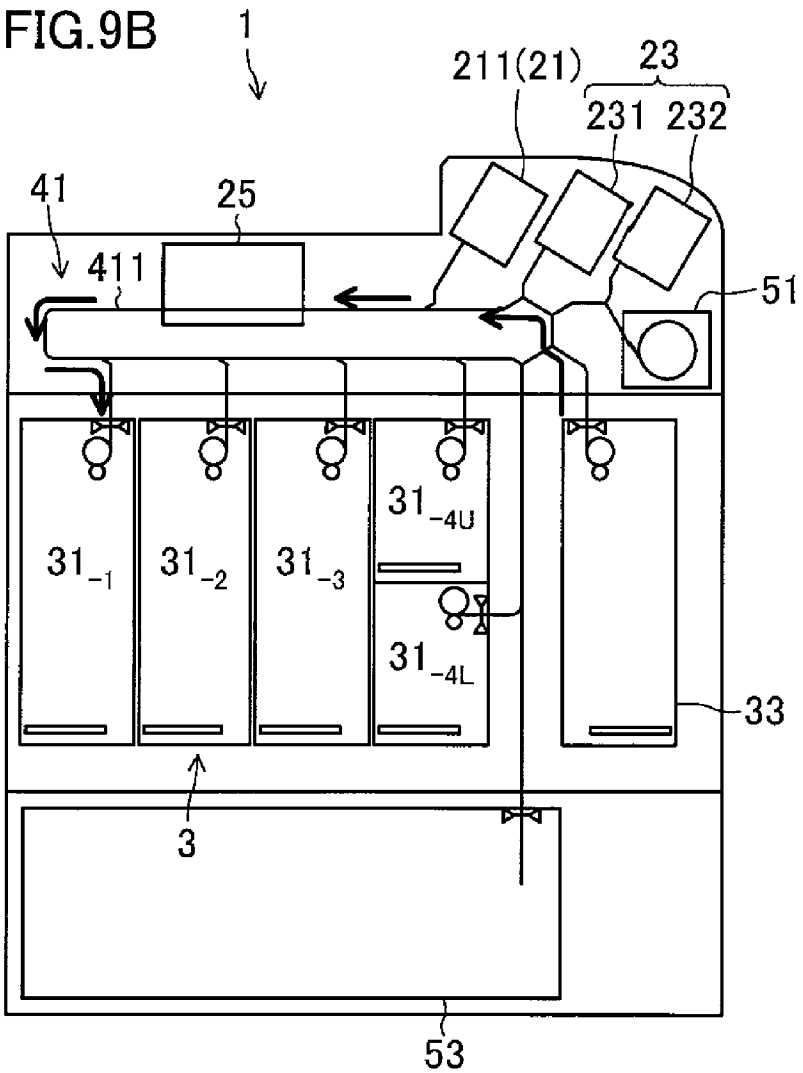
FIGS. 9A and 9B show how the banknotes are transported in a reconciliation process.
Figure 9A:
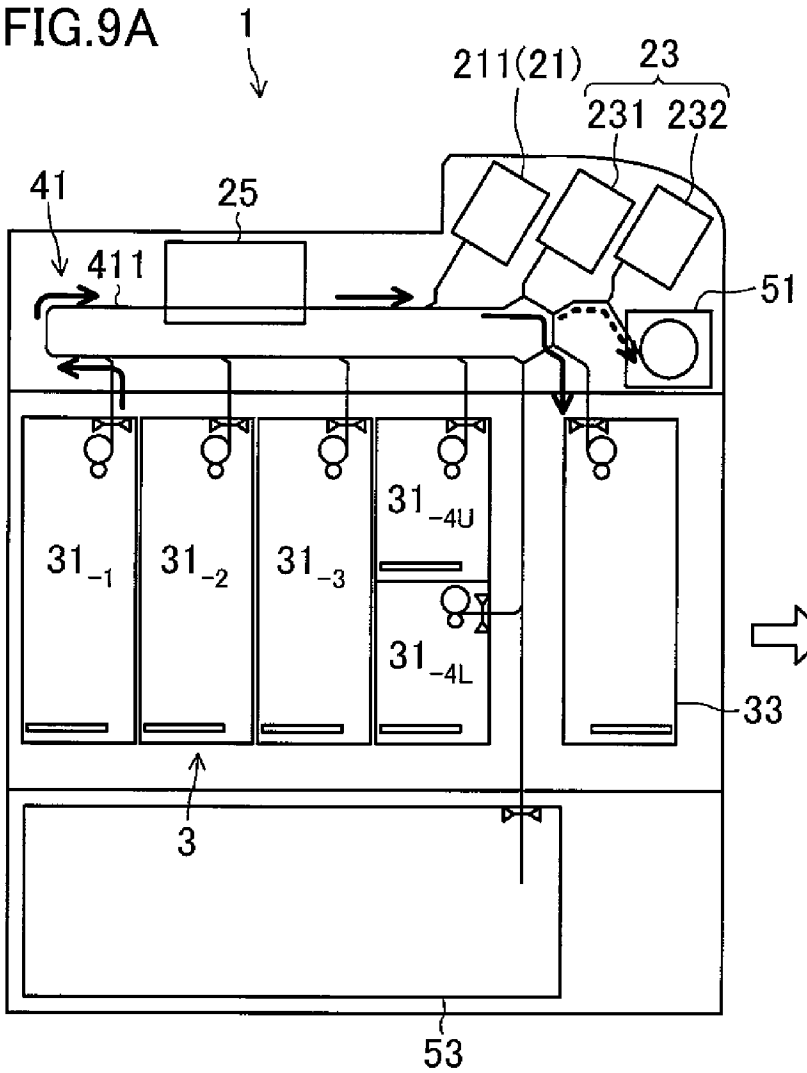

In the full reconciliation process, as shown in FIG. 9A, the banknotes are fed one by one from the target storage cassette 31 (the first storage cassette $\mathbf{31}_{-1}$ is the target in the example shown in FIGS. 9A and 9B). The transport unit 41 transports the fed banknotes to the recognition unit 25 through the looped transport path 411, and the recognition unit 25 recognizes and counts the banknotes, and reads the serial numbers of the banknotes. The banknotes which have been recognized as the normal banknotes and all digits of the serial numbers of which have been read are transported to the reconciliation cassette 33 as indicated by solid arrows in FIG. 9A, and stored therein. The rejected banknotes are transported to the rejected banknote escrow unit 51 as indicated by dashed arrows in FIG. 9A, and stored therein.

After all the banknotes stored in the target storage cassette 31 are fed and counted, the banknotes stored in the reconciliation cassette 33 are fed one by one, and transported to the recognition unit 25 through the looped transport path 411 as shown in FIG. 9B. Thus, the recognition unit 25 recognizes and counts the banknotes again, and reads the serial numbers of the banknotes again. Then, the normal banknotes are stored in the original storage cassette 31 again, i.e., the target storage cassette 31. Thus, the banknotes stored in the storage cassette 31 are identified, the inventory amount stored in the memory unit 59 is updated, and the serial number list corresponding to the storage cassette 31 is updated. When the banknotes are rejected when they are returning from the reconciliation cassette 33 to the storage cassette 31, the rejected banknotes are transported to the rejected banknote escrow unit 51, and stored therein.

The partial reconciliation process is performed when irregular transport occurs while the banknotes are traveling from or to the storage cassette 31. When such irregular transport occurs, the number of the banknotes stored in the storage cassette 31 may be different from the counted number. Thus, the banknotes stored in the storage cassette 31 need to be identified. Examples of the irregular transport include the case where the recognition unit 25 has detected that the banknotes are overlapped in the dispensing process, for example, or the case where the banknotes transported in the depositing process are jammed.

When the banknotes are overlapped in the dispensing process, the number of the banknotes fed from the storage cassette 31 is uncertain, and the inventory amount of the storage cassette 31 after the dispensing process is also uncertain. Thus, the partial reconciliation process is performed on all the storage cassettes 31 from which the overlapped banknotes are fed so that at least the inventory amount of each storage cassette 31 is determined.

When the banknote is jammed in the depositing process, the operator needs to remove the jammed banknote. When the banknote is jammed near the inlet of the storage cassette 31, the banknote which has been determined as being stored in the storage cassette 31 may be removed, and the number of the banknotes in the storage cassette 31 may be different from the counted number. Thus, the reconciliation process needs to be performed on the storage cassette 31 in which the number of the banknotes may be changed due to the irregular transport.

In the partial reconciliation process, the above-described serial number list is used. Thus, the banknotes stored in the storage cassette 31 can be identified by merely feeding some of the banknotes from the storage cassette 31. As compared with the full reconciliation process, a load of the reconciliation process can be reduced, and time required for the reconciliation process is significantly reduced. Specifically, the banknotes can be specified by reading the serial numbers of the banknotes fed from the storage cassette 31, and the fed banknotes can be identified on the list by checking the read serial number against the serial number list because the serial numbers in the serial number list are arranged in the stored order. This can identify the banknotes which are not fed from the storage cassette 31 and remain in the storage cassette 31.

In the stacking storage cassette 31, however, the order of the banknotes may change in storing the banknotes. In such a case, the order of the banknotes passing the recognition unit 25 does not match the order of the banknotes actually stored in the storage cassette 31. Thus, even when a single banknote is fed from the storage cassette 31, and the serial number thereof is identified, the banknotes remaining in the storage cassette 31 cannot precisely be identified when the order of the banknotes has changed.

In the partial reconciliation process performed by the depositing/dispensing machine 1, the serial numbers of two or more banknotes are checked against the serial number list so that the banknotes can be identified even when the order of the banknotes has changed. Details of the partial reconciliation process will be described with reference to the drawings.

In the partial reconciliation process, two or more banknotes are sequentially fed from the target storage cassette 31. The number of the banknotes fed from the cassette can suitably be set, and can be set based on the number of the banknotes whose order may change in storing them. The minimum required number of the banknotes is two. As the number of the fed banknotes increases, the accuracy of the partial reconciliation process increases. However, this increases the load of the process and time required for the process. Thus, the number of the fed banknotes may preferably be set in view of the load and time. In this example, five banknotes are fed.

Figures 10A, 10B, 10C, 10D, 10E:
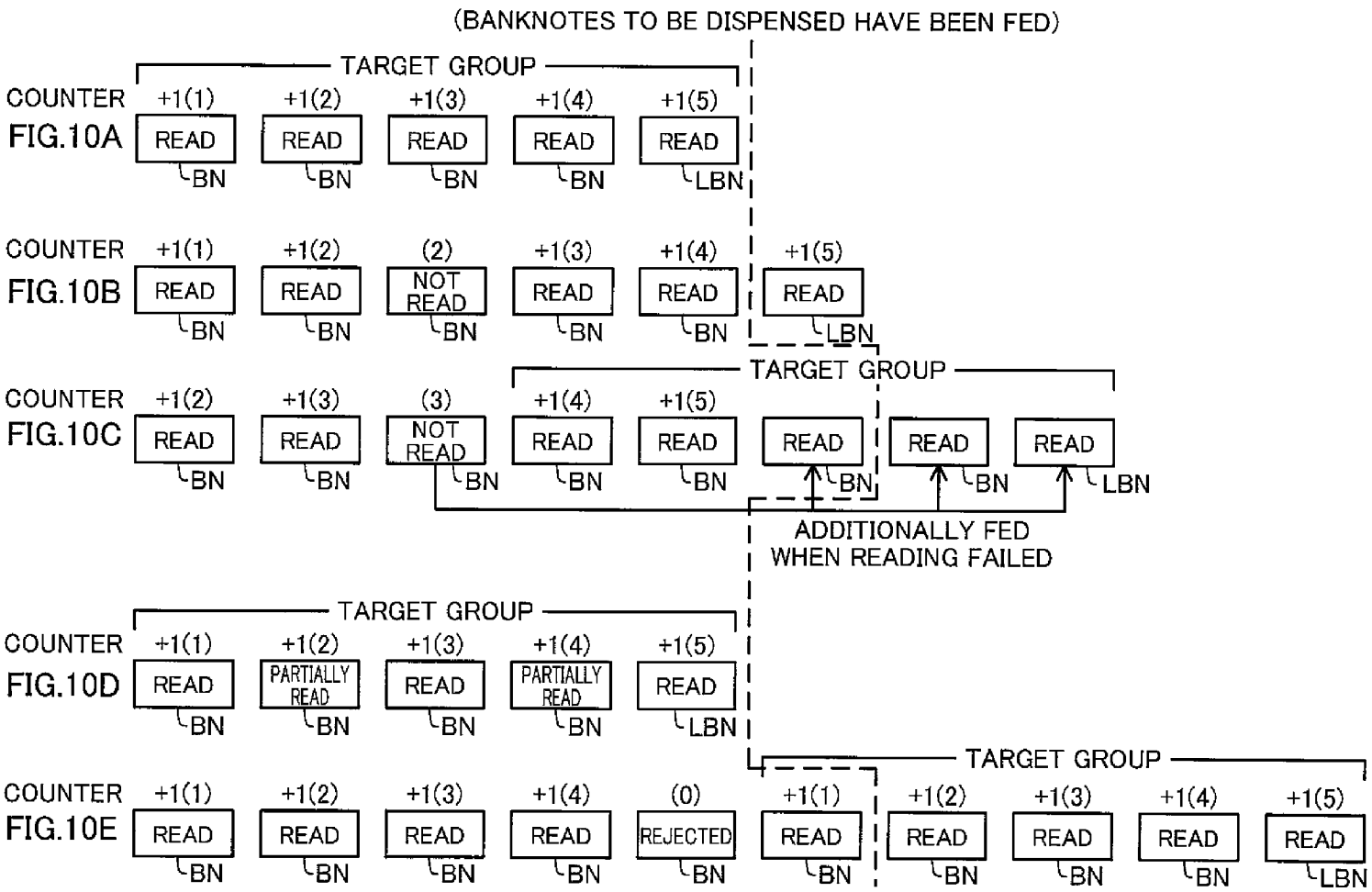
FIGS. 10A-10E show examples of feeding of the banknotes in the reconciliation process etc.

The banknotes fed from the storage cassette 31 are transported by the transport unit 41 to the recognition unit 25 in the same manner as in the full reconciliation process described above. The recognition unit 25 recognizes and counts the banknotes, and reads the serial number of the banknotes in real-time. The banknotes which have been recognized as the normal banknotes, and their serial numbers have been read are transported to the reconciliation cassette 33 and stored therein (see FIG. 9A). Thus, when the five successive banknotes BN whose serial numbers have been read are sequentially fed from the storage cassette 31 as shown in FIG. 10A, the feeding of the banknotes from the storage cassette 31 is stopped. In FIGS. 10A-10E, the banknote BN relatively on the left is the banknote which is fed earlier from the storage cassette 31, and the banknote BN relatively on the right is the banknote which is fed later from the storage cassette 31. The serial numbers of the five successive banknotes BN including the banknote LBN last fed from the storage cassette 31 are grouped. The group is a target group including the serial numbers which will be checked against the serial number list.

As described above, the recognition unit 25 reads the serial numbers of the banknotes in real-time. When the serial number of a certain banknote has not been read, a substitutive banknote is additionally fed from the storage cassette 31. FIG. 10B shows an example in which the third fed banknote BN is rejected because its serial number is not read, and an additional banknote is fed after the five banknotes are fed, but the target group cannot be set.

In this case, the banknotes are kept fed from the storage cassette 31 until the counter counts 5. For example, in an example of FIG. 10C, the serial number of the third fed banknote is not read, and the banknotes are additionally fed from the storage cassette 31. Then, the serial numbers of five successive banknotes including the banknote LBN last fed from the storage cassette 31 are read when three additional banknotes are fed. Thus, the target group is set.

As described in detail later, some digits of the read serial numbers may be masked in checking the serial numbers against the serial number list. This reduces the frequency of the feeding of the additional banknotes when the serial number does not match the serial number list. Thus, even when all digits of the serial number are not read, the serial number can be checked against the serial number list as long as at least some of the digits are read. For example, in an example of FIG. 10D, not all digits but only some digits of the serial numbers of some of the banknotes are read. Thus, unlike the example of FIG. 10C, the feeding of the banknotes is finished without feeding the additional banknotes. The number of the some digits is determined based on the number of the digits masked in the checking. For example, when three of seven digits of the serial number are masked, and at least four digits have been read, the feeding of the additional banknotes is not necessary. When only three or less digits have been read, it is determined that the serial number has not been read, and the banknotes are additionally fed. When some of the digits have been read as shown in FIG. 10D, the feeding of the additional banknotes may be required in checking the serial numbers as described later.

When the banknote fed in the partial reconciliation process is rejected, the counter is reset to zero. Thus, when the banknote is rejected, at least five banknotes are additionally fed as shown in FIG. 10E.

When the target group which will be checked against the serial number list is determined in this way, the target group is checked against the serial number list, and a group of the serial numbers in the serial number list corresponding to the target group (a reference group) is determined. The target group corresponds to the banknotes fed from the storage cassette 31. Accordingly, the reference group indicates a boundary between the banknotes fed from the storage cassette 31 and the banknotes remaining in the storage cassette 31 in the serial number list. Therefore, when the reference group is identified in the serial number list, the banknotes remaining in the storage cassette 31 can be identified based on the serial number list.

Figures 11A, 11B:
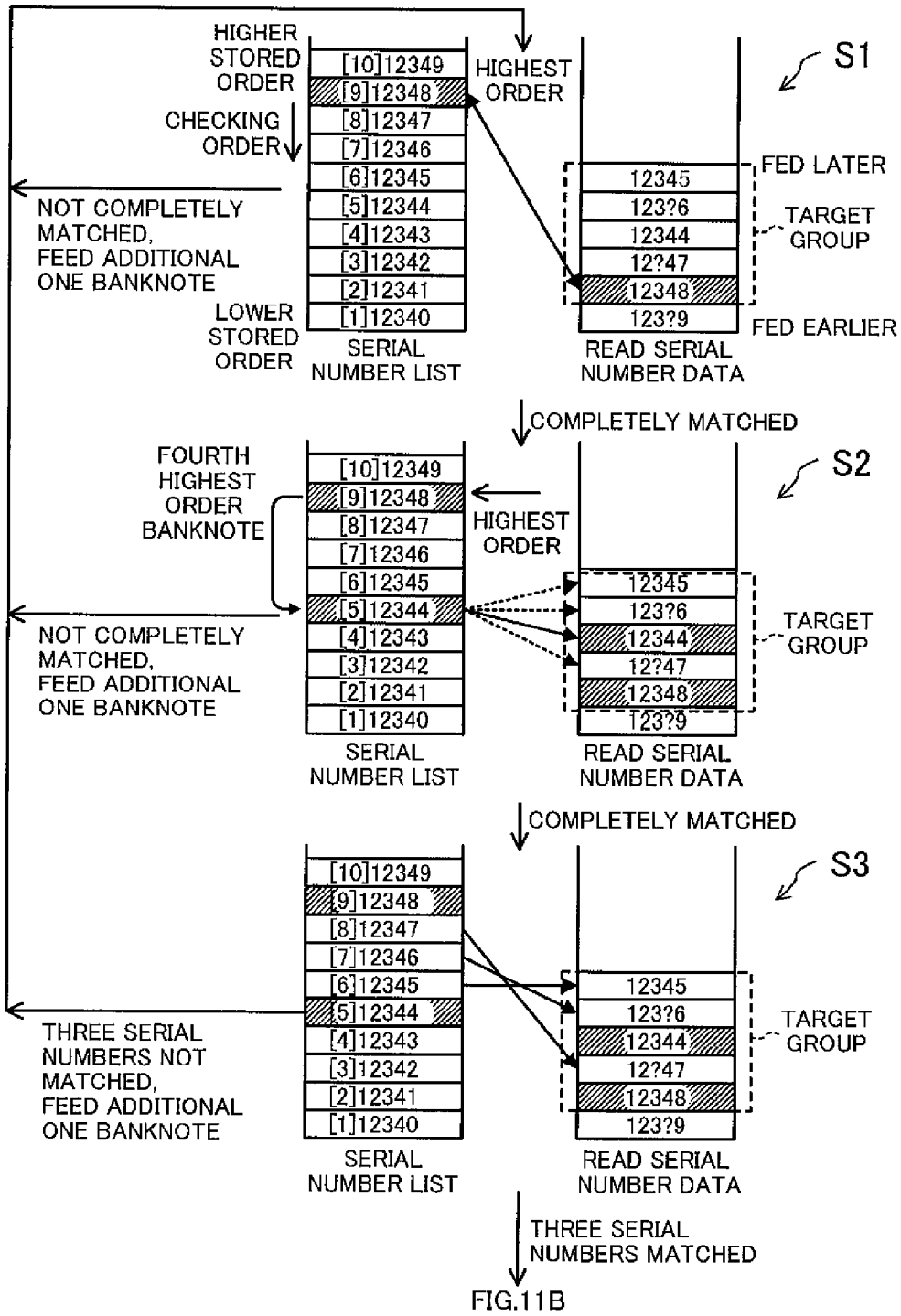
FIGS. 11A-11B show how the banknotes are checked in the reconciliation process etc.

Referring to FIGS. 11A-11B, how the target group of the serial numbers of the five successive banknotes including the banknote last fed from the storage cassette 31 is checked against the serial number list will be described below. In the serial number list shown in FIGS. 11A-11B, "12340," "12341," etc. are the serial numbers. The number indicated in an upper column is higher in the stored order, and the number indicated in a lower column is lower in the stored order. The numbers in the brackets are consecutive numbers of the banknotes in the storage cassette 31, and correspond to the number of the banknotes stored in the storage cassette 31. Read serial number data is data of the serial number read by the recognition unit 25, and data in the upper column corresponds to the banknote fed later, and data in the lower column corresponds to the banknote fed earlier. That is, the data can be considered as the serial numbers of the banknotes stored in the reconciliation cassette 33 arranged in the stored order. Symbol "?" indicates a digit which has not been read.

Each of the serial numbers in the target group is checked against the serial numbers in the serial number list from the higher order serial number, i.e., the serial number of the banknote stacked in an upper level in the storage cassette 31. In this step, the serial number which shares all digits with the serial number in the target group, and is in the highest order in the serial number list is identified (step S1). The order of the serial number in the target group does not matter, as long as the serial number is contained in the target group.

In step S1, when the serial numbers in the target group do not share all digits with the serial numbers in the serial number list, an additional banknote is fed from the target storage cassette 31 on which the reconciliation is performed, and the target group including the additionally fed banknote (suppose that the serial number of the additional banknote has already been read) is set again, and then step S1 is repeated. When the serial number which shares all digits with the serial number in the serial number list is found in the target group, the flow proceeds to step S2. The serial number in the highest order is "12348" in the example shown in the drawing.

In step S2, the fourth highest serial number relative to the highest order serial number identified in step S1 in the serial number list (hereinafter this serial number is referred to as the lowest order serial number) is identified, and it is determined whether the serial number which shares all digits with the lowest order serial number is contained in the target group or not. Also in this step, the order of the serial number in the target group does not matter. When the serial number which shares all digits with the lowest order serial number is not contained in the target group, an additional banknote is fed from the target storage cassette 31, and a target group including the additional banknote is set again, and the flow returns to step S1. When the serial number which shares all digits with the lowest order serial number is found in the target group, the flow proceeds to step S3. The serial number which shares all digits is "12344" in the example shown in the drawing.

In step S3, three serial numbers between the highest order serial number and the lowest order serial number in the serial number list are checked against the serial numbers in the target group. In this checking, it is determined whether the serial numbers share only some of the digits or not. For example, three of the digits of the serial number are masked in the checking. Specifically, even when the serial numbers do not share three digits, it is determined that the serial numbers match each other when the serial numbers share the other digits. The number of the masked digits is not limited to 3, and the number of the masked digits may suitably be determined. In this checking, the order of the serial numbers in the target group does not matter. When the target group does not include any serial number which matches the three serial numbers in the serial number list, an additional banknote is fed from the target storage cassette 31, and the target group is set again, and then the flow returns to step S1. When the serial numbers which match the three serial numbers, respectively, are found in the target group, the flow proceeds to step S4. In the example shown in the drawing, "12345" among the three serial numbers "12345," "12346," and "12347" shares all digits with the serial number in the target group, while "12346" and "12347" share only some of the digits with the serial numbers in the target group.

In step S4, a reference group in which all the serial numbers in the serial number list which match the serial numbers in the target group are contained in any order is identified. As described above, the reference group corresponds to a boundary between the banknotes fed from the storage cassette 31 and the banknotes remaining in the storage cassette 31 after the feeding. It can be determined that the banknote corresponding to the lowest order serial number in the reference group, and the banknotes having the serial numbers in the order higher than the lowest order have been fed from the storage cassette 31. In the following step S5, information of the serial numbers contained in the reference group, and the serial numbers in the order higher than the reference group is deleted from the serial number list. In the example shown in the drawing, the serial number "12344" and the serial numbers in the order higher than "12344" are deleted. By updating the serial number list in this way, the banknotes remaining in the storage cassette 31 are identified.

Then, as shown in FIG. 9B, the banknotes contained in the reconciliation cassette 33 are fed one by one, and transported to the recognition unit 25. The recognition unit 25 recognizes and counts the banknotes, and reads the serial numbers of the banknotes. The banknotes which have been recognized as the normal banknotes and whose serial numbers have been read are returned to the original storage cassette 31, i.e., the target storage cassette 31. Then, the inventory amount stored in the memory unit 59 is updated, and the serial number list of the target storage cassette 31 is updated. Thus, the identification is finished.

As described above, in the partial reconciliation process, the banknotes stored in the storage cassette 31 can be identified by merely feeding some of the banknotes stored in the storage cassette 31. Thus, as compared with the full reconciliation process, a load of the process can be reduced, and time required for the process can be reduced.

In the partial reconciliation process, the two or more serial numbers are checked irrespective of the order. Thus, the reconciliation process can precisely be performed even when the order of the banknotes has changed. In checking the two or more serial numbers, it is determined whether the serial number in the reference group and the serial number in the target group share only some of the digits or not, thereby advantageously reducing the load of the process. In checking the highest order serial number and the lowest order serial number in the reference group, it is determined whether the serial number in the reference group and the serial number in the target group share all digits or not. Thus, the reference group can precisely be identified, or the boundary in the serial number list can precisely be identified. This improves accuracy of the reconciliation process.

(Identification Process in Dispensing Process)

The identification process for identifying the banknotes in the storage cassette 31 is performed also in the dispensing process. The identification process in the dispensing process can be performed in the same manner as that in the partial reconciliation process described above. In the dispensing process, however, the number of the banknotes dispensed to the outlet 231 has been determined. Thus, at least the determined number of the banknotes need to be fed from the storage cassette 31. The identification process can be performed simultaneously with the dispensing process.

In the identification process in the dispensing process, whether the feeding continues or stops can be controlled by using the counter of the serial numbers as described above. Specifically, the serial numbers of the banknotes dispensed in the dispensing process are read one by one. A vertical broken line shown in FIGS. 10A-10E indicates a point of time when the dispensing of the banknotes in the dispensing process is finished. The feeding of the banknotes may be stopped when the counter counts 5 or more when the dispensing of the banknotes in the dispensing process is finished as shown in FIG. 10A. In this case, the target group is set to include the serial numbers of five banknotes fed before the dispensing in the dispensing process is finished. The banknotes fed in this process are all dispensed to the first outlet 231 (suppose that the banknotes are not rejected).

When the serial number of a certain banknote has not been read, and the counter counts less than 5 when the dispensing of the banknotes in the dispensing process is finished as shown in FIG. 10B, the banknotes are fed from the storage cassette 31 until the counter counts 5. Then, as shown in FIG. 10C, the feeding of the banknotes is continued so that the target group including the serial numbers of five successive banknotes is set. The additionally fed banknotes are not dispensed to the outlet 231, but are transported to the rejected banknote escrow unit 51, and stored therein. Specifically, in FIGS. 10A-10E, the banknotes on the right of the broken line indicating the point of time when the dispensing of the banknotes in the dispensing process is finished are the additionally fed banknotes, and are transported to the rejected banknote escrow unit 51.

Likewise, as shown in FIG. 10E, when the banknote is rejected, at least five banknotes are additionally fed from the storage cassette. Among the fed banknotes, the normal banknote as a substitute of the rejected banknote is dispensed to the first outlet 231, and the other banknotes are transported to the rejected banknote escrow unit 51.

Figure 12:
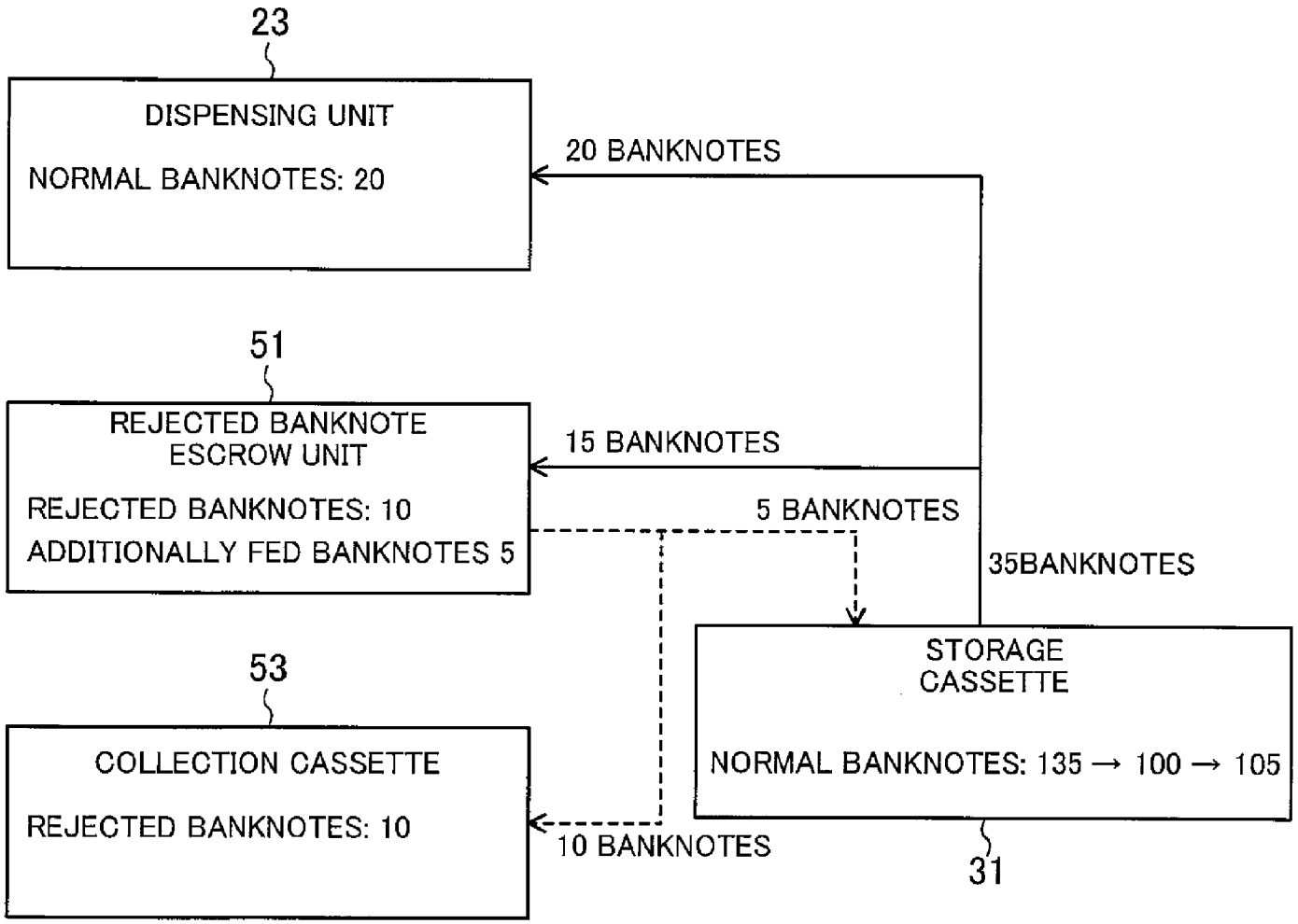
FIG. 12 shows an example how the banknotes are transported in the dispensing process.

As a result, the banknotes may be transported in the identification process in the dispensing process as shown in FIG. 12, for example. Suppose that a command to dispense 20 banknotes from the storage cassette containing 135 banknotes is given. Then, when 10 banknotes are rejected in feeding the banknotes in the dispensing process, 20 normal banknotes are transported to the dispensing unit 23, and the 10 rejected banknotes are transported to the rejected banknote escrow unit 51. As described above, when 5 banknotes are additionally fed from the storage cassette 31 to set the target group for the identification process, the 5 banknotes are transported to the rejected banknote escrow unit 51. As a result, among 35 banknotes fed from the storage cassette 31, 20 banknotes are transported to the dispensing unit 23 (the outlet), and 15 banknotes including the rejected banknotes and the additionally fed banknotes are transported to the rejected banknote escrow unit 51. at this time, the storage cassette 31 stores 100 banknotes. The number of the rejected banknotes transported to the rejected banknote escrow unit 51 is uncertain when the rejected banknotes are overlapped or connected. However, the number of the rejected banknotes can be obtained by logical operation by subtracting the number of the banknotes transported to the outlet 231 from the number of the banknotes fed from the storage cassette 31.

When the banknotes are fed to set the target group even in the dispensing process, the target group is checked against the serial number list according to the procedure shown in FIGS. 11A-11B. Thus, the reference group is identified, and the banknotes stored in the storage cassette 31 are identified.

When the identification process in the dispensing process is finished, the banknotes stored in the rejected banknote escrow unit 51 are returned to the storage cassette 31, if necessary. In the example shown in FIG. 12, the 10 rejected banknotes are transported to the collection cassette 53 and stored therein, and the 5 additionally fed banknotes are transported to the original storage cassette 31 and stored therein as indicated by broken arrows. At this time, the storage cassette 31 stores 105 banknotes. The number of the rejected banknotes transported to the collection cassette 53 can be obtained by logical operation by subtracting the number of the banknotes returned to the storage cassette 31 from the number of the banknotes fed from the rejected banknote escrow unit 51.

In this example, as shown in FIG. 10A, the serial numbers are read while the banknotes are dispensed in the dispensing process, and the target group is set when the dispensing is finished. Different from this example, the serial numbers may not be read while the banknotes are dispensed in the dispensing process, and the banknotes may be fed for the identification process after the dispensing is finished. Specifically, after the dispensing process is finished, at least 5 banknotes may additionally be fed from the storage cassette 31 to set the target group. This advantageously reduces the load of the dispensing process, and reduces time required for the dispensing process. To set the target group of the serial numbers of 5 banknotes fed before and after the dispensing of the banknotes in the dispensing process is finished, the reading of the serial numbers may be started from the banknote which is fed earlier by the predetermined number than a period when the dispensing of the banknotes in the dispensing process is finished (when the target group is supposed to contain 5 serial numbers, the predetermined number is 1-4).

(Identification Process in Returning Process)

When an error etc. has occurred in the depositing process, a returning process is performed to return the banknotes which are once deposited through the outlet 231. As described above, the depositing/dispensing machine 1 is configured to directly store the banknotes placed in the inlet 211 in the depositing process in the storage cassette 31 without temporarily storing them in the escrow unit. Thus, when an error etc. has occurred in the depositing process, listed banknotes (banknotes contained in the serial number list), and non-listed banknotes (banknotes not contained in the serial number list before confirming the depositing process) are contained in the storage cassette 31. Since the depositing/dispensing machine 1 is configured to manage the banknotes by using the serial numbers, the listed banknotes and the non-listed banknotes can be distinguished by using the serial number list.

Specifically, before executing the depositing process, the highest order serial number in the serial number list is stored in advance. Then, when the error has occurred in the depositing process, and the returning process is performed, the recognition unit 25 reads the serial numbers of the banknotes fed from the storage cassette 31, and banknotes are kept fed from the storage cassette 31 until the banknote having the serial number same as the stored highest order serial number is fed. The fed banknotes are dispensed to the dispensing unit 23. Then, when the banknote having the same serial number as the highest order serial number is fed, the feeding of the banknotes from the storage cassette 31 is stopped. The banknote having the highest order serial number is the listed banknote, and the banknotes fed after the listed banknote are also the listed banknotes. Thus, the returning process can be finished without performing the full reconciliation process.

As described above, in the stacking storage cassette 31, the order of the banknotes stored therein may change in storing them, and therefore, the order of the serial numbers in the serial number list may not match the order of the banknotes actually stored in the storage cassette 31. When such mismatch has occurred, and the banknotes are fed from the storage cassette 31 until the banknote having the same serial number as the highest order serial number is fed and dispensed to the outlet 231 as described above, the banknotes are dispensed more than necessary.

Figure 13:
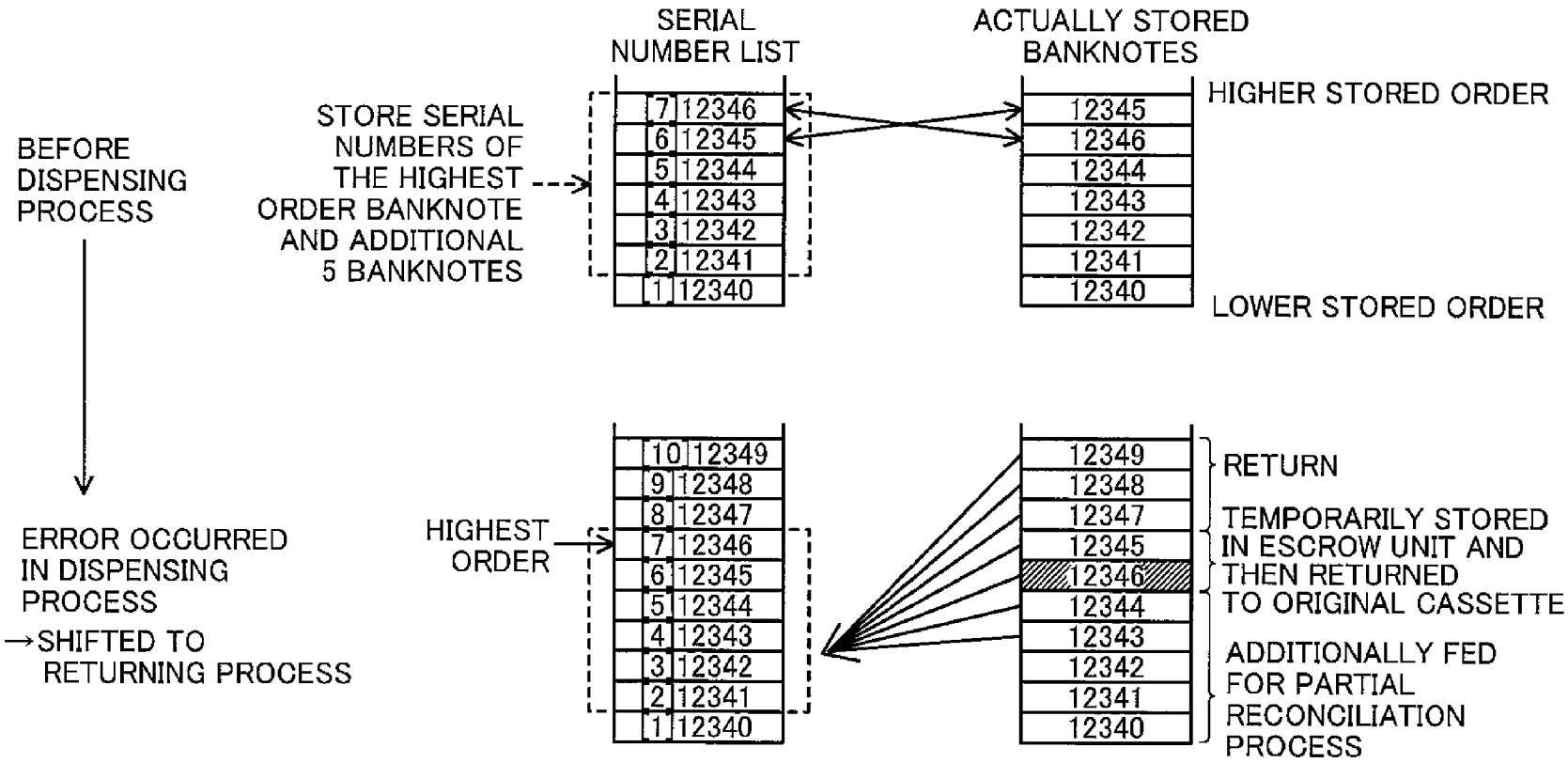
FIG. 13 shows how the banknotes are checked in the returning process.

Thus, as shown in an upper part of FIG. 13, the serial numbers of 5 successive banknotes following the banknote having the highest order serial number in the serial number list are additionally stored before performing the depositing process. The number of the additional banknotes is not limited to 5 as long as the serial number of one or more banknotes is stored. The number may suitably be determined in view of the change of the order of the banknotes. When the number of the additional banknotes increases, the number of the serial numbers to be checked increases, thereby increasing the load and time of the process. In the example shown in the drawing, the highest order serial number is "12346," and the order of the banknotes actually stored in the storage cassette 31 is different from the order of the serial numbers in the serial number list.

In this state, provided that an error has occurred in the depositing process as shown in a lower part of FIG. 13. In the returning process performed thereafter, the storage cassette 31 feeds the banknotes one by one, and the recognition unit 25 reads the serial numbers of the banknotes as described above. Then, the read serial numbers are checked against the 6 serial numbers including the highest order serial number in the list. Specifically, the banknotes in the storage cassette are sequentially fed from the banknote in the higher stored order in FIG. 13, and checked against the 6 stored serial numbers. When the serial number of the fed banknote does not match the stored serial number, the banknote is recognized as the non-listed banknote which is being deposited, and is dispensed to the first outlet 231. When the serial number of the fed banknote matches the stored serial number, the banknote is recognized as the listed banknote, and is not transported to the outlet 231, but transported to the rejected banknote escrow unit 51. As described above, when the banknote having the serial number matching the highest order serial number in the list ("12346" in the example shown in the drawing) is fed, it is determined that the non-listed banknotes which are being deposited are all fed from the storage cassette 31. Thus, the returning process is finished.

In this example, the partial reconciliation process may also be performed together with the returning process to identify the banknotes in the storage cassette 31 after the returning process. Specifically, as shown in the lower part of FIG. 13, at least 5 banknotes are fed from the storage cassette 31 after the banknote having the same serial number as the highest order serial number in the list is fed. The 5 banknotes are fed to set the target group for the identification process, such as the partial reconciliation process, etc., as described above. When the serial numbers are not read, or the banknote is rejected, the required number of banknotes is additionally fed.

After the target group is set by additionally feeding the banknotes in this way, the banknotes are checked against the serial number list according to the procedure shown in FIGS. 11A-11B to identify the reference group. Thus, the banknotes in the storage cassette 31 after the returning process can be identified.

(Switching Between Serial Number Management Mode and Count Management Mode)

As described above, the banknote depositing/dispensing machine 1 stores the serial number list, and the banknotes stored in the storage cassette 31 are managed using the serial number list. On the other hand, the banknote depositing/dispensing machine 1 manages the number of the banknotes stored in each of the storage cassettes 31 based on the counters shown in FIG. 4A, without using the serial numbers. Specifically, the control unit 513 counts the number of the banknotes sent to or fed from the storage cassette 31 by detecting the passage of the banknotes using the passage sensor 312 provided at the port of the storage cassette 31, and increases or decreases the counter.

The banknote depositing/dispensing machine 1 has two management modes. One is a serial number management mode in which the banknotes stored in the storage cassette 31 are managed using the serial number list, and the other is a count management mode in which the banknotes are managed by counting the number of the banknotes stored in the storage cassette 31 without using the serial number. The banknote depositing/dispensing machine 1 is switchable between the two management modes. The identification process, such as the partial reconciliation process described above, can be performed in the serial number management mode, while the partial reconciliation process cannot be performed in the count management mode. Thus, the processes which can be performed by the banknote depositing/dispensing machine 1 are different in the serial number management mode and in the count management mode. The banknote depositing/dispensing machine 1 can have more functions in the serial number management mode than in the count management mode. Thus, the banknote depositing/dispensing machine 1 is basically operated in the serial number management mode. However, when the full reconciliation process is required in the serial number management mode, relatively long time is required for the full reconciliation process, and the banknote depositing/dispensing machine 1 cannot be used until the full reconciliation process is finished. This may disturb the teller's business. To avoid such disturbance, the serial number management mode is switched to the count management mode so that the banknote depositing/dispensing machine 1 can continuously be operated. Processes performed by the banknote depositing/dispensing machine 1 to switch the mode will be described with reference to a flowchart of FIG. 14.

In step S121 after the start of the flow, the banknote depositing/dispensing machine 1 is operated in the serial number management mode. As described above, the banknote depositing/dispensing machine 1 is basically operated in the serial number management mode.

Figure 11B:
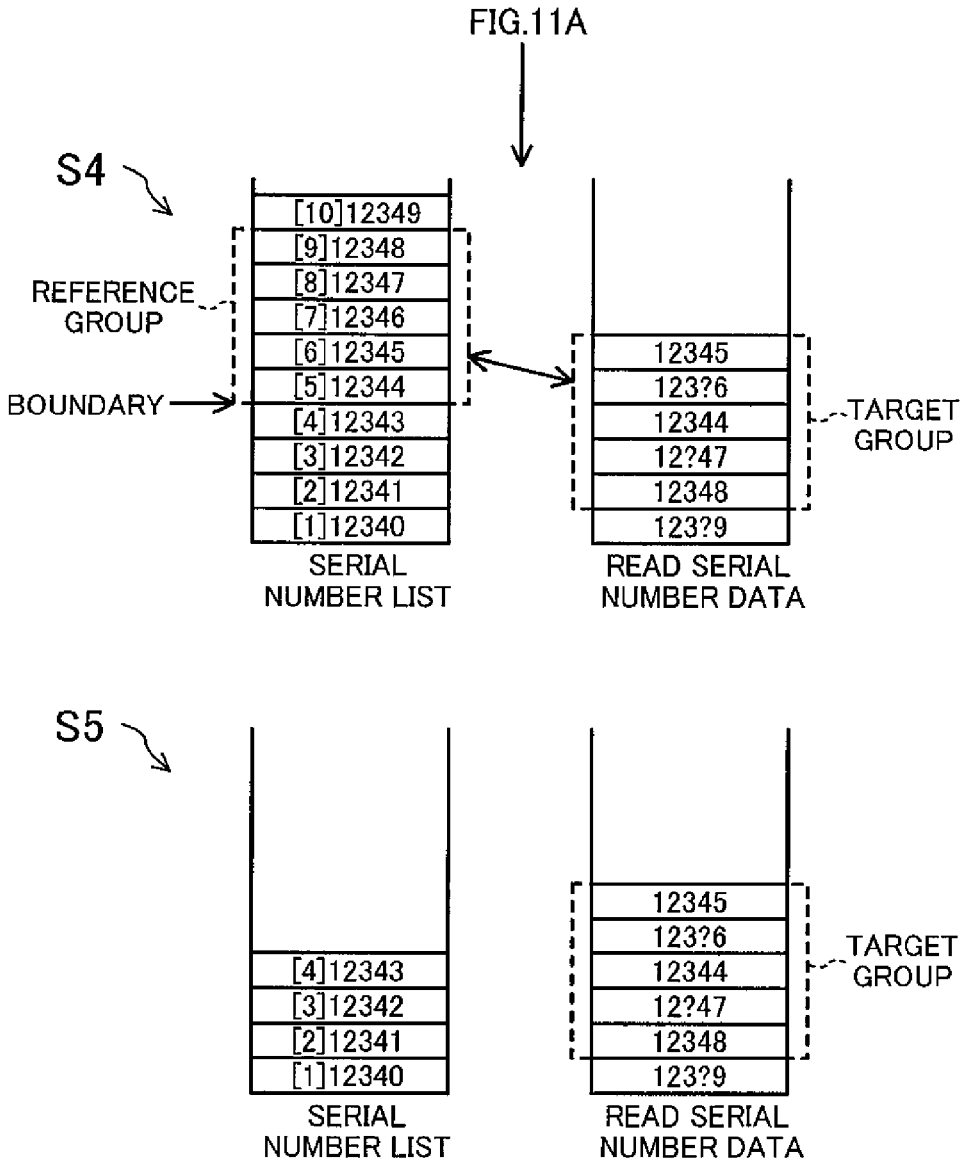

In step S122, it is determined whether an error has occurred in the banknote depositing/dispensing machine 1 or not. When the error has not occurred, step S122 is repeated. When the error has occurred, the flow proceeds to step S123. After recovery from the error in step S123, it is determined in step S124 whether the full reconciliation process or the partial reconciliation process is necessary or not. When it is determined in step S124 that the full reconciliation process and the partial reconciliation process are both unnecessary, the flow proceeds to step S126, and the banknote depositing/dispensing machine 1 is continuously operated in the serial number management mode. When it is determined that the partial reconciliation process is necessary, the flow proceeds to step S125 to perform the partial reconciliation process (see FIGS. 10 and 11). As described above, only some of the banknotes stored in the storage cassette 31 are fed in the partial reconciliation process. Thus, time required for the partial reconciliation process is relatively short, and the teller's business is not disturbed even when the banknote depositing/dispensing machine 1 cannot be used during the partial reconciliation process. Thus, different from the full reconciliation process described later, the partial reconciliation process is surely performed so that the apparatus can continuously be operated in the serial number management mode (step S126).

Figure 15:
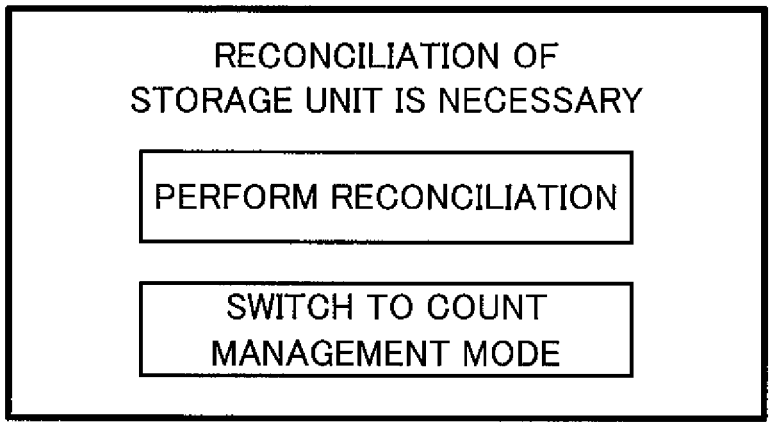
FIG. 15 shows an example of a screen displayed in the serial number management mode.

When it is determined that the full reconciliation process is necessary, the flow proceeds to step S127. In step S127, the higher-ranking terminal or the display unit 511 of the banknote depositing/dispensing machine 1 shows on a screen a message asking an operator (e.g., a teller) to select execution of the full reconciliation process, or switching to the count management mode without performing the full reconciliation process as shown in FIG. 15. When the operator has selected the execution of the full reconciliation process through predetermined operation at the higher-ranking terminal or the operation unit 55, the flow proceeds from step S127 to step S128 to perform the full reconciliation process as described above. When the full reconciliation process is finished, the apparatus can be operated continuously in the serial number management mode, and therefore, the flow returns to step S126.

When the operator has selected the switching to the count management mode through predetermined operation at the higher-ranking terminal or the operation unit 55, the full reconciliation process is not performed. Thus, the flow proceeds from step S127 to step S129 to operate the banknote depositing/dispensing machine 1 in the count management mode. In this mode, the management using the serial numbers is not performed. Thus, the banknote depositing/dispensing machine 1 can be used continuously even when an error has occurred. Thus, the teller's business is not disturbed.

Figure 16:
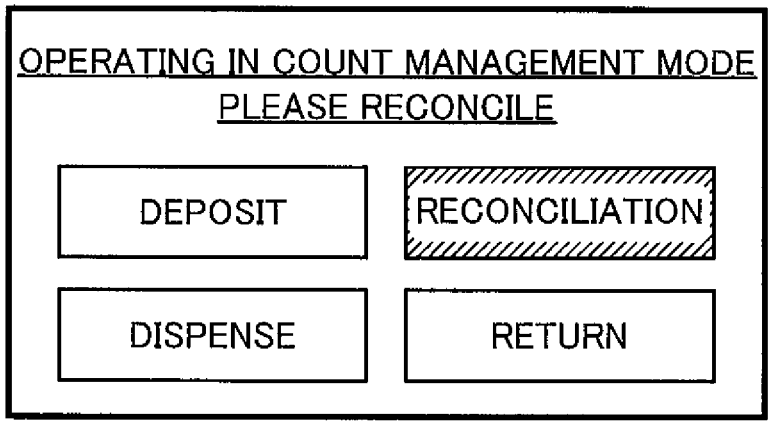
FIG. 16 shows an example of a screen displayed in the count management mode.

While the banknote depositing/dispensing machine 1 is operated in the count management mode, the higher-ranking terminal or the display unit 511 shows on the screen that the banknote depositing/dispensing machine 1 is being operated in the count management mode, and shows a message encouraging the operator to perform the reconciliation process. For example, FIG. 16 shows an example of an operation screen (i.e., a menu screen) showing buttons for selecting the depositing process, the dispensing process, the returning process, and the reconciliation process. On this screen, messages "operated in the count management mode," and "perform reconciliation" are displayed. As shown in FIG. 16, the button for selecting the reconciliation process may be highlighted to encourage the operator to perform the reconciliation process so that the banknote depositing/dispensing machine 1 can quickly be returned to the serial number management mode.

In step S1210, it is determined whether the operator has selected the execution of the full reconciliation process or not. When the execution of the full reconciliation process is selected, the flow proceeds to step S128. Thus, the full reconciliation process is performed as described above, and the banknote depositing/dispensing machine 1 returns to the serial number management mode (step S126). The operator may select the execution of the full reconciliation process, for example, when the teller's window is not busy, and the teller's business is not disturbed even when the full reconciliation process is performed for a long time.

When the operator has not selected the execution of the full reconciliation process, the flow proceeds from step S1210 to step S1211, and it is determined whether it is business hours or not. The flow returns to step S129 when it is business hours. Specifically, during the business hours, the full reconciliation process is not performed unless the operator selects the execution of the full reconciliation process. When it is not business hours, the flow proceeds to step S128 to forcedly perform the full reconciliation process to return to the serial number management mode. When it is not business hours, the teller's business is not disturbed. Thus, it is more advantageous to return to the serial number management mode by performing the full reconciliation process.

With the provision of the two management modes of the serial number management mode and the count management mode, the banknote depositing/dispensing machine 1 can continuously be operated by switching to the count management mode, even when the banknote depositing/dispensing machine 1 is not continuously operated in the serial number management mode. This can avoid the banknote depositing/dispensing machine 1 from being substantially unavailable for a long time while the reconciliation process is performed. This can prevent the disturbance to the teller's business.

The switching to the count management mode, and the execution of the full reconciliation process can optionally be done by the selecting operation of the operator, depending on the use conditions of the banknote depositing/dispensing machine 1. This improves convenience to users. Although not shown in the flowchart of FIG. 14, when an error which requires the full reconciliation process has occurred in the count management mode, the mode is preferably returned to the serial number management mode by forcedly performing the full reconciliation process.

After the mode is switched to the count management mode, the mode can quickly be returned to the serial number management mode by encouraging the operator to perform the full reconciliation process. When it is not business hours, the full reconciliation process is forcedly performed to return to the serial number management mode, thereby enabling the banknote depositing/dispensing machine 1 to perform the multiple functions.

Figure 14:
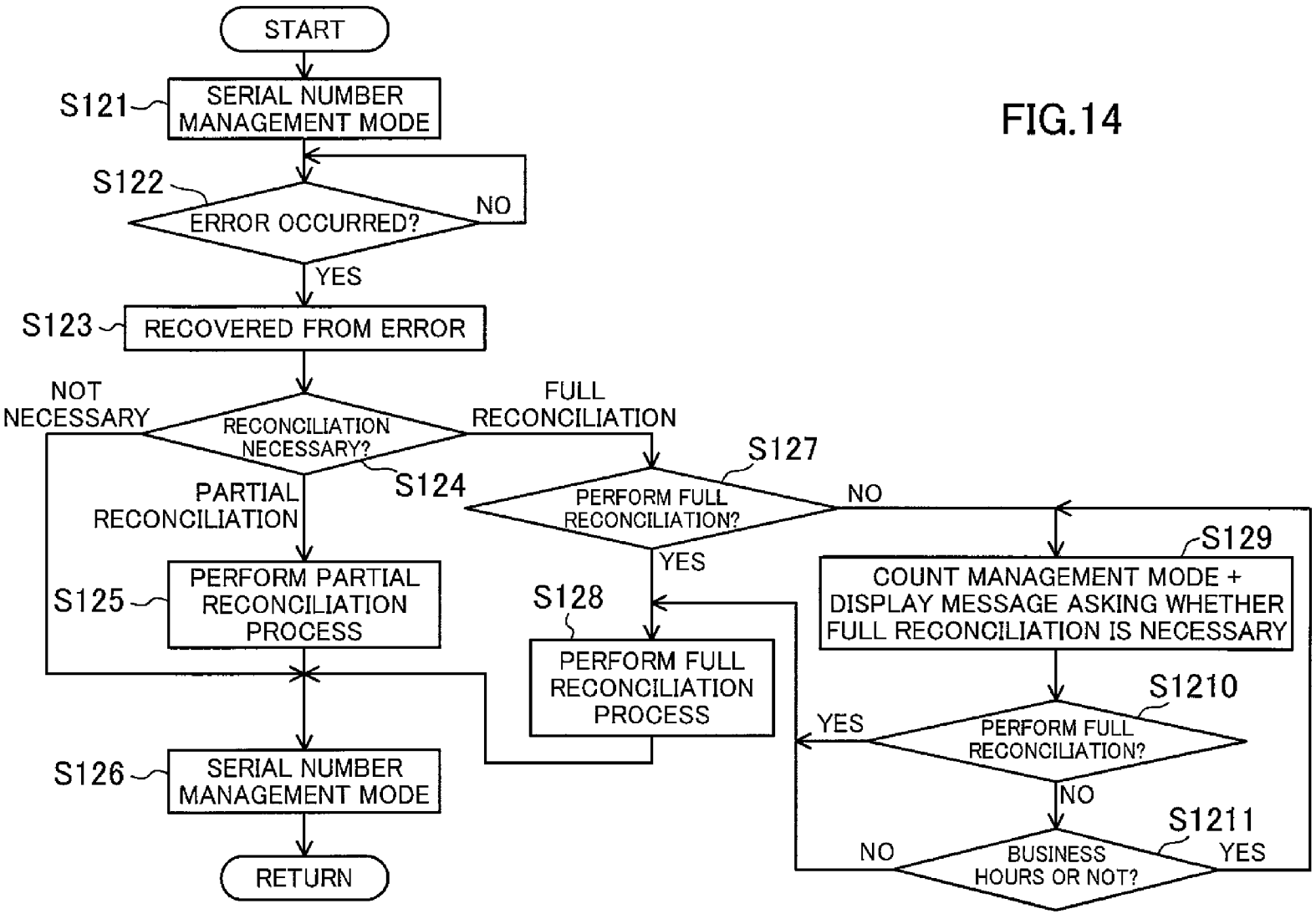
FIG. 14 shows a flowchart of switching between a serial number management mode and a count management mode.

In the flowchart shown in FIG. 14, the partial reconciliation process is performed when the partial reconciliation process is required, thereby continuing the operation in the serial number management mode. When the partial reconciliation process is necessary, like when the full reconciliation process is necessary, the operator may be asked to select the execution of the partial reconciliation process, or the switching to the count management mode without performing the partial reconciliation process.

When the full reconciliation process is necessary, the banknote depositing/dispensing machine 1 may continuously be operated by automatically switching the mode to the count management mode without the selection by the operator. In this case, when it is not business hours, the full reconciliation process may automatically be performed to return to the serial number management mode. The same may be applied to the case when the partial reconciliation process is necessary.

The above-described banknote depositing/dispensing machine 1 includes the reconciliation cassette 33 as shown in FIG. 2. In performing the full reconciliation process and the partial reconciliation process, the banknotes fed from the target storage cassette 31 on which the reconciliation is performed are stored in the reconciliation cassette 33. However, providing the reconciliation cassette 33 which is generally empty except for when the reconciliation process is performed is not advantageous in view of capacity of the apparatus and downsizing of the apparatus. Thus, this cassette may be used as one of the storage cassettes (a fifth storage cassette 31) instead of using it as the reconciliation cassette. When the full reconciliation process is performed in this case, the target storage cassette 31 is detached from the casing 131, and all the banknotes stored therein are removed by hand. The removed banknotes are placed in the inlet 211, and fed one by one to be transported to the recognition unit 25 in the same manner as the depositing process described above. Then, the recognition unit 25 recognizes and counts the banknotes, and reads the serial numbers of the banknotes, and the banknotes passed through the recognition unit 25 are stored to the original storage cassette 31. In this way, the full reconciliation process can be performed. However, as compared with the above-described automatic reconciliation process using the reconciliation cassette 33, the operator needs to open/close the first door 133 etc. in manually performing the reconciliation process, thereby increasing the time required for the reconciliation process, and complicating the operator's work. Therefore, in the banknote depositing/dispensing machine 1 in which the manual reconciliation process is necessary, the configuration which enables the selection between the execution of the full reconciliation process and the switching to the count management mode is more advantageous in avoiding the disturbance to the teller's business. In performing the partial reconciliation process in the banknote depositing/dispensing machine 1 which does not include the reconciliation cassette 33, the banknotes fed from the target storage cassette 31 can be stored in the rejected banknote escrow unit 51. The banknotes rejected in this process may be transported to the first or second outlet 231 or 232.

In the flowchart shown in FIG. 14, the mode is switched to the count management mode when the full reconciliation process is required in the serial number management mode, and the required full reconciliation process is not performed yet. In other words, the mode is switched to the count management mode when a possibility that the serial number of the banknote stored in the storage cassette 31 does not match the serial number in the serial number list is detected in the serial number management mode.

In the flowchart shown in FIG. 14, the mode is switched to the serial number management mode when the full reconciliation process is performed in the count management mode. In other words, the mode is switched to the serial number management mode when the serial number of the banknote stored in the storage cassette 31 has matched the serial number in the serial number list in the count management mode.

Further, when a success rate of the reading of the serial number is not higher than a predetermined value in the serial number management mode, the mode can be switched to the count management mode. Whether the reading of the serial number succeeds or not depends on the condition of the banknote. Thus, when the reading success rate is relatively low, it can be presumed that a relatively large number of the banknotes whose serial numbers are not precisely read are distributed, and improvement in the reading success rate is not expected. When the serial number cannot be read, the banknotes cannot be managed by using the serial numbers. In such a case, the mode may automatically or manually be switched to the count management mode to operate the banknote depositing/dispensing machine 1 in the count management mode.

Instead of switching the mode between the serial number management mode and the count management mode based on the conditions, the serial number management mode and the count management mode may optionally be selected as a setting of the banknote depositing/dispensing machine. For example, when the serial number management mode is selected as an initial setting, and the reading success rate remains lower than the predetermined value for a long time, the mode may automatically or manually be switched to the count management mode. Conversely, when the count management mode is selected as the initial setting, and the reading success rate remains higher than the predetermined value for a long time, the mode may automatically or manually be switched to the serial number management mode.

The disclosed technology is not limited to the depositing/dispensing machine for depositing and dispensing the banknotes, and may be applied to a depositing machine for depositing the banknotes, or a dispensing machine for dispensing the stored banknotes.

What is claimed is:

1. A banknote handling apparatus for handling banknotes each having a unique code, the apparatus comprising:

a storage unit configured to store the banknotes, and feed stored banknotes;

a recognition unit configured to read the codes of the banknotes to be stored in the storage unit; and a control unit, wherein the control unit has a code management mode in which the banknotes stored in the storage unit are managed by identifying the banknotes one by one based on the codes read by the recognition unit, and a count management mode in which the banknotes stored in the storage unit are managed by counting the banknotes to be stored in the storage unit without identifying the banknotes one by one, and the banknote handling apparatus is switchable between the code management mode and the count management mode.

2. The banknote handling apparatus of claim 1, wherein a switching condition for switching the banknote handling apparatus between the code management mode and the count management mode is previously determined, and the switching between the code management mode and the count management mode is performed based on the switching condition.

3. The banknote handling apparatus of claim 2, wherein the switching condition includes a condition, such that in the code management mode, when the banknotes stored in the storage unit cannot be identified one by one, a reconciliation process for identifying the banknotes stored in the storage unit one by one based on the codes read by the recognition unit is required, and the required reconciliation process is not performed yet.

4. The banknote handling apparatus of claim 2, further comprising:

a memory unit configured to store the codes of the banknotes stored in the storage unit, wherein the switching condition includes a condition that a possibility that one of the codes of the banknotes stored in the storage unit does not match one of the codes of the banknotes stored in the memory unit is detected in the code management mode.

5. The banknote handling apparatus of claim 2, further comprising:

a memory unit configured to store the codes of the banknotes stored in the storage unit, wherein the switching condition includes a condition, such that in the count management mode, a reconciliation process is performed whereby the banknotes stored in the storage unit are identified one by one based on the codes read by the recognition unit, and the codes of the banknotes stored in the storage unit match the codes of the banknotes stored in the memory unit.

6. The banknote handling apparatus of claim 1, configured to be able to select the code management mode or the count management mode.

7. A banknote handling apparatus, for handling banknotes each having a unique code, the apparatus comprising:

a storage unit configured to store the banknotes, and feed stored banknotes;

a recognition unit configured to read the codes of the banknotes to be stored in the storage unit; and a control unit, wherein the control unit has a code management mode in which the banknotes stored in the storage unit are managed based on the codes read by the recognition unit, and a count management mode in which the banknotes stored in the storage unit are managed by counting the banknotes to be stored in the storage unit, and the banknote handling apparatus is switchable between the code management mode and the count management mode; wherein a switching condition for switching the banknote handling apparatus between the code management mode and the count management mode is previously determined, the switching between the code management mode and the count management mode is performed based on the switching condition, and the switching condition includes a condition that a success rate of the reading of the codes by the recognition unit is not higher than a predetermined value in the code management mode.

* * * * *